US008029094B2

(12) United States Patent
Yoshino et al.

(10) Patent No.: US 8,029,094 B2
(45) Date of Patent: Oct. 4, 2011

(54) LIQUID EJECTION APPARATUS AND LIQUID STORAGE PORTION OF LIQUID EJECTION APPARATUS

(75) Inventors: Keiichiro Yoshino, Matsumoto (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 714 days.

(21) Appl. No.: 11/937,005

(22) Filed: Nov. 8, 2007

(65) Prior Publication Data

US 2008/0106572 A1 May 8, 2008

(30) Foreign Application Priority Data

Nov. 8, 2006 (JP) ..... 2006-302479
Nov. 28, 2006 (JP) ..... 2006-319736

(51) Int. Cl.
*B41J 2/165* (2006.01)

(52) U.S. Cl. ..... 347/36

(58) Field of Classification Search ..... 347/36
See application file for complete search history.

(56) References Cited

U.S. PATENT DOCUMENTS 6,422,691 B2 * 7/2002 Kobayashi et al. ..... 347/86

FOREIGN PATENT DOCUMENTS

| | | | |
|---|---|---|---|
| JP | 2001-130029 A | | 5/2001 |
| JP | 2002-29065 A | | 1/2002 |
| JP | 2003-326745 A | | 11/2003 |
| JP | 2004-025807 A | | 1/2004 |
| JP | 2004-25808 A | | 1/2004 |
| JP | 2004-188629 A | | 7/2004 |
| JP | 2005-088419 A | | 4/2005 |
| JP | 2006-021451 A | * | 1/2006 |

* cited by examiner

*Primary Examiner* — Stephen Meier
*Assistant Examiner* — Alexander C Witkowski
(74) *Attorney, Agent, or Firm* — Sughrue Mion, PLLC

(57) ABSTRACT

A liquid ejection apparatus includes a liquid ejection head that discharges liquid, a liquid receiving portion that receives the liquid from the liquid ejection head, a detachable liquid storage portion that stores the liquid within the liquid receiving portion, and a liquid passage that conducts the liquid within the liquid receiving portion into the liquid storage portion. The liquid storage portion includes an absorbing portion that absorbs the liquid, and a scattering prevention portion that prevents scattering of the liquid.

8 Claims, 18 Drawing Sheets

FIG. 3A

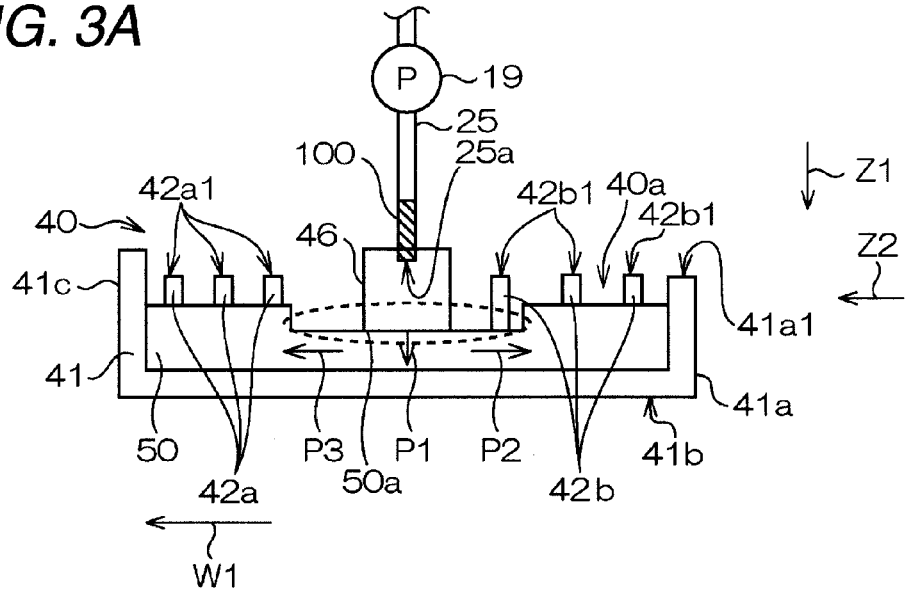

FIG. 3B

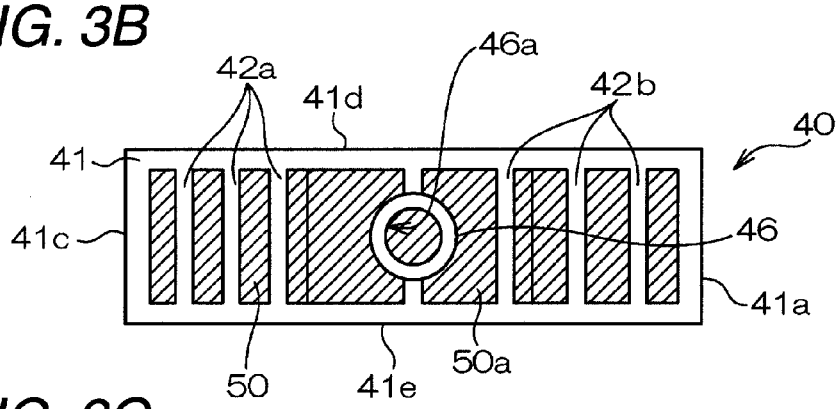

FIG. 3C

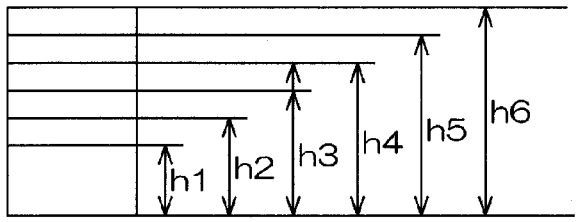

h1 = HEIGHT FROM A WASTE INK TANK BOTTOM TO THE SURFACE OF AN ABSORBING MATERIAL RECESS h2 = HEIGHT FROM THE WASTE INK TANK BOTTOM TO THE SURFACE OF AN ABSORBING MATERIAL h3 = HEIGHT FROM THE WASTE INK TANK BOTTOM TO AN UPPER FACE OF A REAR WALL (HEIGHT OF THE REAR WALL)

h4 = HEIGHT FROM THE WASTE INK TANK BOTTOM 4 TO THE UPPER FACES OF ABSORBING MATERIAL PRESSERS (HEIGHT OF ABSORBING MATERIAL PRESSERS)

h5 = HEIGHT FROM THE WASTE INK TANK BOTTOM TO A PUMP TUBE OUTLET (HEIGHT OF PUMP TUBE)

h6 = HEIGHT FROM THE WASTE INK TANK BOTTOM TO A CYLINDER RIB UPPER FACE (HEIGHT OF CYLINDER RIB)

EXPRESSION 1 : $h1<h2<h3 \leqq h4<h5<h6$

LIQUID EJECTION APPARATUS AND LIQUID STORAGE PORTION OF LIQUID EJECTION APPARATUS

BACKGROUND

1. Technical Field

The present invention relates to a liquid ejection apparatus that ejects liquid, and a liquid storage portion of the liquid ejection apparatus.

2. Related Art

Conventionally, for example, an ink-jet recording apparatus that is a liquid ejection apparatus is provided with an ink-jet recording head. Further, the ink-jet recording head is provided with a number of nozzles for discharging ink onto a recording sheet, etc. Fine ink droplets are discharged onto a recording medium from the nozzles, thereby recording records images, such as desired characters or figures.

Further, the ink-jet recording apparatus is provided with a cleaning mechanism for sealing the above nozzles to prevent the viscosity of the ink within the nozzles from increasing, or for removing the viscous ink that causes poor discharge, by sucking ink, etc.

The above-mentioned cleaning mechanism stores the sucked ink (hereinafter referred to as "waste ink") within a waste ink tank in an ink-jet recording apparatus through a tube (hereinafter referred to as "pump tube"). The pump tube becomes a passage of the waste ink, which is an example of liquid, to the waste ink tank, and becomes an example of a liquid passage. The waste ink tank is an example of a liquid storage portion.

Further, the waste ink tank has a housing that is a main body of the waste ink tank, and is constructed such that an absorbing portion that absorbs waste ink is arranged within a housing of the tank. Also, the waste ink tank has a construction in which waste ink is absorbed and held by the absorbing portion.

Conventionally, in order to prevent the ink-jet recording apparatus from being soiled with ink, a construction in which a leakage ink receptacle for receiving waste ink is arranged on a waste ink tank is disclosed (for example, Patent Document 1).

Patent Document 1: JP-A-2004-188629 (FIG. 1, etc.)

However, waste ink may remain in the vicinity of the outlet of the pump tube that is a passage of waste ink to the waste ink tank, and bubbles may be entrained within the waste ink remaining in the pump tube. In such a case, when the waste ink tank is detached, there is a possibility that the bubbles within waste are burst, and the waste ink is scattered to surroundings, thereby polluting surroundings. Further, if bubbles are entrained in waste ink, the apparent amount of the waste ink increases due to the bubbles when the waste ink is discharged to and absorbed by the absorbing material. Thus, the waste ink may overflow, and may soil the ink-jet recording apparatus.

Moreover, the surface of the waste ink tank that faces the tube, i.e., the open face of the absorbing material of the waste ink tank may be soiled with the waste ink.

In this case, if the waste ink tank is detached from the liquid ejection apparatus in order to replace the waste ink tank, there is a possibility that a user may touch the surface of the waste ink tank that faces the tube, i.e., the open face of the absorbing material of the waste ink tank, and the user may be soiled with the waste ink.

SUMMARY

An advantage of some aspects of the invention is to provide a liquid ejection apparatus capable of preventing scattering, overflow, and natural fall remaining in a liquid passage when a liquid storage portion is detached or after the liquid storage portion is detached; and a liquid storage portion of the liquid ejection apparatus. The advantage can be attained by at least one of the following aspects:

A first aspect of the invention provides a liquid ejection apparatus including a liquid ejection head that discharges liquid, a liquid receiving portion that receives the liquid from the liquid ejection head, a detachable liquid storage portion that stores the liquid within the liquid receiving portion, and a liquid passage that conducts the liquid within the liquid receiving portion into the liquid storage portion. The liquid storage portion includes an absorbing portion that absorbs the liquid, and a scattering prevention portion that prevents scattering of the liquid.

In the above construction, a liquid storage portion of a liquid ejection apparatus including a liquid ejection head that discharges liquid, a liquid receiving portion that receives the liquid from the liquid ejection head, the detachable liquid storage portion that stores the liquid within the liquid receiving portion, and a liquid passage that conducts the liquid within the liquid receiving portion into the liquid storage portion is provided with an absorbing portion that absorbs the liquid, and a scattering prevention portion that prevents scattering of the liquid.

According to this construction, the liquid storage portion has a scattering prevention portion that prevents scattering of the liquid.

Accordingly, if the liquid remains in the liquid passage when the liquid storage portion is detached from the liquid ejection apparatus, the scattering prevention portion can prevent the surroundings from being soiled, even when bubbles, etc. are entrained into the liquid, and are burst and scattered when they are stored in the liquid storage portion through the liquid passage, or even when the liquid itself is scattered, like when the liquid is discharged from the liquid passage, when the liquid from the liquid receiving portion that receives the liquid from the liquid ejection head is stored in the liquid storage portion through a liquid passage, etc.

Also, liquid can be absorbed by the absorbing portion. Further, since the apparent amount of liquid increases due to the entrainment of bubbles into liquid, it is possible to prevent liquid from overflowing and being scattered to surroundings when liquid is stored in the liquid storage portion through the liquid passage.

Preferably, the scattering prevention portion is an introducing dripping portion that drips the liquid of the liquid passage to lead the drips into the absorbing portion.

According to this construction, the scattering prevention portion is an introducing dripping portion that drips the liquid of the liquid passage to lead the drips into the absorbing portion.

Accordingly, even when bubbles are entrained in the liquid remaining in the liquid passage or the viscosity of the liquid rises, the remaining liquid is forcibly dripped by the introducing dripping portion that is the scattering prevention portion. Thus, the liquid can be carried along the introducing dripping portions and can be absorbed by the absorbing portion without soiling surroundings. Further, since the liquid remaining in the liquid passage is forcibly dripped when the liquid storage portion is attached and detached, the liquid can be prevented from being scattered, and the liquid ejection apparatus can be prevented from being soiled.

Preferably, the scattering prevention portion is arranged in a position corresponding to a position of the liquid passage when the liquid storage portion is installed in the liquid ejection apparatus.

According to the above construction, the scattering prevention portion is arranged in a position corresponding to the position of the liquid passage when the liquid storage portion is installed in the liquid ejection apparatus. Accordingly, scattering of liquid, etc. can be prevented efficiently.

Preferably, the scattering prevention portion is arranged so as to surround the liquid passage.

According to this construction, since the scattering prevention portion is arranged so as to surround the liquid passage, a scattering prevention effect becomes still better, and the liquid remains in the liquid passage dripped can be forcibly dripped.

Preferably, the scattering prevention portion is provided so as not to contact the liquid passage when the liquid storage portion is attached to and detached from the liquid ejection apparatus.

According to the above construction, the scattering prevention portion is provided so as not to contact the liquid passage when the liquid storage portion is attached to and detached from the liquid ejection apparatus. Accordingly, even when bubbles are entrained in the liquid during attachment and detachment, the bubbles are absorbed while they are accurately dropped into the absorbing portion by the scattering prevention portion. Thus, the surroundings of the liquid storage portion are not soiled.

A second aspect of the invention provides a liquid storage portion of a liquid ejection apparatus including a liquid ejection head that discharges liquid, a liquid receiving portion that receives the liquid from the liquid ejection head, the liquid storage portion that is detachable and that stores the liquid within the liquid receiving portion, and a liquid passage that conducts the liquid within the liquid receiving portion into the liquid storage portion. The liquid storage portion includes an absorbing portion that absorbs the liquid, and a scattering prevention portion that prevents scattering of the liquid.

According to this construction, the liquid storage portion of the liquid ejection apparatus includes a scattering prevention portion that prevents scattering of the liquid, and a scattering prevention portion that prevents scattering of the liquid. Therefore, when bubbles, etc. are entrained into liquid and are discharged through the liquid passage, the scattering prevention portion can prevent surroundings from being soiled due to scattering of the bubbles, scattering of the ink, etc., and can make the waste ink absorbed by the absorbing portion.

Preferably, the liquid storage portion has a liquid storage portion body having an open face that opens a part of a surface corresponding to the liquid passage, the absorbing portion is arranged inside the liquid storage portion body, and the scattering prevention portion is provided at the open face, and is arranged in a position corresponding to the liquid passage.

According to this construction, the liquid storage portion has a liquid storage portion body having an open face that opens a part of a surface corresponding to the liquid passage, the absorbing portion is arranged inside the liquid storage portion body, and the scattering prevention portion is provided at the open face, and is arranged in a position corresponding to the liquid passage.

Accordingly, since the scattering prevention portion is arranged in correspondence with the position where liquid is discharged when the liquid storage portion is installed in the apparatus, scattering of liquid can be prevented efficiently.

Preferably, the scattering prevention portion is an introducing dripping portion that drips the liquid of the liquid passage to lead the drips into the absorbing portion.

Accordingly, even when bubbles are entrained in the ink remaining in the liquid passage or the viscosity of the ink rises, the remaining liquid is dripped by the introducing dripping portion that is the scattering prevention portion, and is delivered by the introducing dripping portion, so that the remaining ink can be absorbed by the absorbing portion without soiling surroundings.

Preferably, the scattering prevention portion is arranged so as to surround the liquid passage when the liquid storage portion is installed in the liquid ejection apparatus.

Preferably, the scattering prevention portion is provided so as not to contact the liquid passage when the liquid storage portion is attached to and detached from the liquid ejection apparatus.

A third aspect of the invention provides a liquid storage portion that absorbs and stores liquid discharged from a guide portion that guides to an absorbing member the liquid discharged by a liquid ejection head, using the absorbing member. The liquid storage portion includes a housing portion having an opening in its surface facing an outlet of the guide portion on the side of the absorbing member, the absorbing member arranged within the housing, a removing member for removing the liquid remaining in the vicinity of the outlet of the guide portion on the side of the absorbing member, and a removing member housing mechanism that houses the removing member so as not to be exposed through the opening when the liquid storage portion is detached.

According to the above construction, the liquid storage portion has a housing portion having an opening in its surface facing an outlet of the guide portion on the side of the absorbing member, the absorbing member arranged within the housing, and a removing member for removing the liquid remaining in the vicinity of the outlet of the guide portion on the side of the absorbing member.

When the liquid storage portion is detached, the liquid remaining in the vicinity of the outlet of the liquid passage is removed and dripped into the absorbing member by the removing member.

Thereby, when the waste ink tank is detached, or after the waste ink tank is detached, scattering or natural falling of the waste ink remaining in the liquid passage is prevented, so that the liquid ejection apparatus can be prevented from being soiled.

Further, according to the above construction, a removing member housing mechanism that houses the removing member so as not to be exposed through the opening when the liquid storage portion is detached is provided.

For this reason, the removing member is housed by the removing member housing mechanism so as not to be exposed through opening when the liquid storage portion is detached. Thus, even after a user and the like have detached the liquid storage portion, the user and the like do not touch the removing member soiled with the liquid. Therefore, the user and the like are not soiled.

Accordingly, according to the above construction, when the liquid storage portion is detached, the liquid remaining in the vicinity of the outlet of the liquid passage can be removed in advance by the removing member, and can be dripped into and absorbed by the absorbing member, and the removing member can be housed by the removing member housing mechanism so as not to be exposed through the opening.

For this reason, the inside of the liquid ejection apparatus is not soiled by scattering or natural fall of the liquid remaining in the vicinity of the outlet of the liquid passage, and, in the bottom, a user and the like are not soiled by the liquid storage portion when or after the liquid storage portion is detached.

Preferably, the removing member housing mechanism has a covering member that covers the removing member.

According to the above construction, when or after the liquid storage portion is detached, the removing member is covered with the covering member. Thus, the removing member is not exposed to the opening of the liquid storage portion, i.e., to the surface of the liquid storage portion facing the guide portion.

Accordingly, since a user and the like do not touch the removing member when or after the liquid storage portion is detached, the user and the like are not soiled.

Preferably, the removing member housing mechanism has a housing portion for housing the removing member within the housing.

According to the above construction, when or after the liquid storage portion is detached, even if liquid has adhered to the removing member and a user and the like touch and are then soiled by the removing member when the liquid remaining in the vicinity of the outlet of the liquid passage is removed by the removing member, the user and the like are not soiled when the liquid storage portion is replaced because the housing portion for housing the removing member within the housing of the liquid storage portion is provided.

Preferably, when the liquid storage portion is attached, the covering member is folded and housed in the vicinity of a wall of the housing portion that is apart from the removing member, and when the liquid storage portion is detached, the covering member is unfolded in the vicinity of a wall of the housing portion that is near to the removing member.

According to the above constructions since the covering member is folded and housed in a position apart from the removing member when the liquid storage portion is attached, a housing space for the covering member can be made small when the liquid storage portion is attached and used. Also, since the cover member is unfolded in the position of the ink removing member when the waste ink tank is detached, the ink removing member can be covered sufficiently.

Accordingly, a user and the like are not soiled when the liquid storage portion is replaced.

Preferably, when the liquid storage portion is attached, the covering member is split and housed in the vicinity of a wall of the housing portion that is apart from the removing member, and when the liquid storage portion is detached, the covering member is integrated and locked to the housing in the vicinity of a wall of the housing portion that is near to the removing member.

According to the above construction, since the covering member is split and housed when the liquid storage portion is attached, the housing space can be made small. Also, since the covering member that is split and housed is integrated and locked to the housing when the liquid storage portion is detached, the removing member can be covered sufficiently.

Accordingly, a user and the like are not soiled when the liquid storage portion is detached and replaced, or the like.

Preferably, the housing portion has a biasing portion that biases the removing member, and when the liquid storage portion is detached, the removing member is housed within the housing by the biasing portion.

According to the above construction, the housing portion has a biasing portion. Also, the removing member is housed within the housing by the biasing portion when the liquid storage portion is detached.

That is, the removing member is housed in the housing portion of the liquid storage portion by the biasing portion.

Accordingly, a user and the like are not soiled when the liquid storage portion is replaced.

A fourth aspect of the invention provides a liquid ejection apparatus including a guide portion that guides the liquid discharged from a liquid ejection head that ejects liquid to an absorbing member, and a liquid storage portion that absorbs and stores the liquid discharged from the guide portion using the absorbing member. Here, the liquid storage portion includes a housing portion having an opening in its surface facing an outlet of the guide portion on the side of the absorbing member, the absorbing member arranged within the housing, a removing member for removing the liquid remaining in the vicinity of the outlet of the guide portion on the side of the absorbing member, and a removing member housing mechanism that houses the removing member so as not to be exposed through the opening when the liquid storage portion is detached.

BRIEF DESCRIPTION OF THE DRAWINGS

The invention will be described with reference to the accompanying drawings, wherein like numbers reference like elements.

FIGS. 3A to 3C are schematic views showing cross sections of the waste ink tank.

DESCRIPTION OF EXEMPLARY EMBODIMENTS

Hereinafter, exemplary embodiments of the invention will be described in detail with reference to the accompanying drawings.

In addition, since the exemplary embodiments to be described below are preferable specific examples of the invention, various kinds of technically preferable limitations are given thereto. However, in the following description, the invention is not limited to those exemplary embodiments so long as there is no particular description of the intent to limit the invention.

First Embodiment

Figure 1:
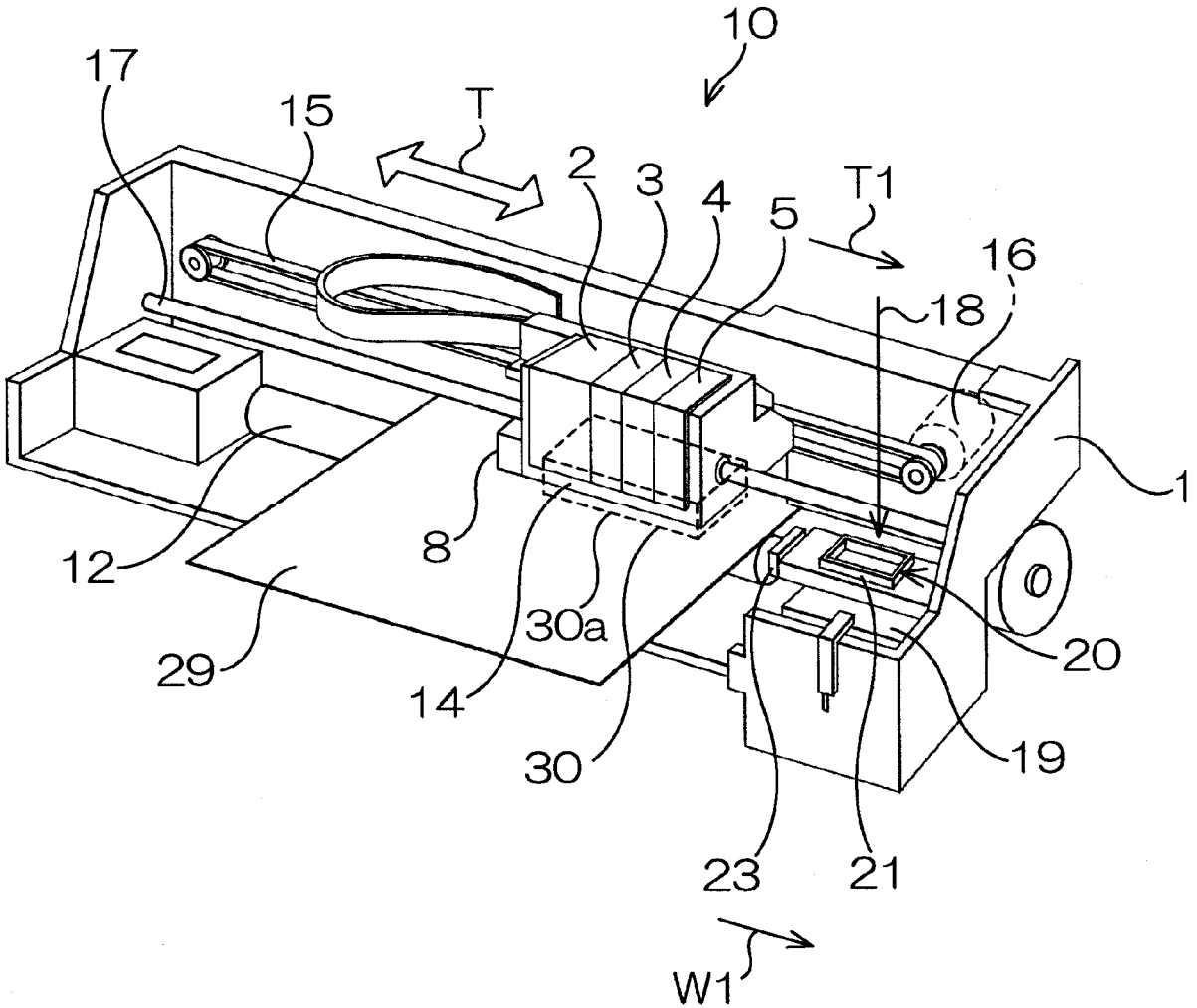
FIG. 1 is a schematic perspective view showing an ink-j et recording apparatus.

FIG. 1 is a schematic perspective view showing an ink-jet recording apparatus (hereinafter referred to as a "recording apparatus") 10 relating to a first embodiment of a liquid ejection apparatus of the invention. The recording apparatus 10 shown in FIG. 1 is also called an ink-jet printer.

The recording apparatus 10 has a main body 1. This main body 1 includes a guide rail 17, a platen 12, a carriage 14, an ink suction device 20, and a recording head 30. The recording head 30 is an example of a liquid ejection head that discharges (hereinafter also referred to as "ejects") ink (an example of liquid) to a recording sheet, and is also called a printing head.

The recording apparatus 10 shown in FIG. 1 is a so-called on-carriage recording apparatus, and has a construction in which a plurality of ink cartridges 2, 3, 4, and 5 can be detachably mounted on an upper portion of the carriage 14. The ink that is an example of liquid is stored in the ink cartridge 2, etc. Black ink is stored in the ink cartridge 2, cyan ink is stored in the ink cartridge 3, yellow ink is stored in the ink cartridge 4, and magenta ink is stored in the ink cartridge 5.

A lower portion of the carriage 14 is provided with the recording head 30. A nozzle plate face 30*a* where the recording head 30 faces a sheet 29 is provided with a nozzle opening for ejecting ink.

The carriage 14 is connected to a motor 16 via a belt 15. As the motor 16 operates, the carriage 14 reciprocates in a main scanning direction T that is an axial direction of the platen 12 along the guide rail 17. As the carriage 14 reciprocates in the main scanning direction T while ink is discharged from the recording head 30, an image is recorded on the sheet 29 that is an example of a recording medium.

A home position 18 is arranged at one end of the guide rail 17. This home position 18 is a non-printed region at an end of a traveling path of the carriage. The ink suction device 20 is arranged in this home position 18. This ink suction device 20 is also called a capping system or capping means, and is an example of a liquid receiving portion. The recording head 30 of the carriage 14 of FIG. 1 moves to the home position 18 along a direction T1, to thereby face a cap body 21 of the ink suction device 20. Then, the ink suction device 20 comes into close contact with the nozzle plate face 30*a* provided with the nozzle opening of the recording head 30.

The ink suction device 20 has a function of preventing drying of the ink in the nozzle opening of the recording head 30 in close contact with the recording head 30, and a function of forcing the negative pressure from the suction pump 19 to act on the nozzle opening to forcibly suck and discharge ink from the nozzle opening.

That is, the ink suction device 20 discharges ink by way of a pump tube 25 (refer to FIG. 3) to be described, in a state of sealing the nozzle opening of the recording head 30, thereby cleaning the recording head 30. A series of such processes is an example for cleaning the recording head 30.

That is, the recording head 30 is cleaned as described above from the recording head 30 that is an example of a liquid ejection head that discharges the ink that is an example of liquid, a cap body of the ink suction device 20 that is an example of a liquid receiving portion that receives the ink discharged from the nozzle opening of the recording head 30, a waste ink tank 40 that is an example of an attachable/detachable liquid storage portion that discharges and stores the ink within the cap body 21 by a suction pump 19, and a pump tube 25 that is an example of a liquid passage that connects the cap body of the ink suction device 20 and the waste ink tank 40 to conduct the ink within the cap of the ink suction device 20 to the waste ink tank 40.

In addition, the above-described suction pump 19 is one constituent element of the ink suction device 20. The suction of ink is an example of discharge of ink. The pump tube 25 is an example of a liquid passage. In addition, a wiper 23 is provided at a side of the ink suction device 20. This wiper 23 wipes away the ink of the nozzle plate face 30*a* of the recording head 30 if necessary. The waste ink tank 40 is an example of a liquid storage portion.

Figure 2:
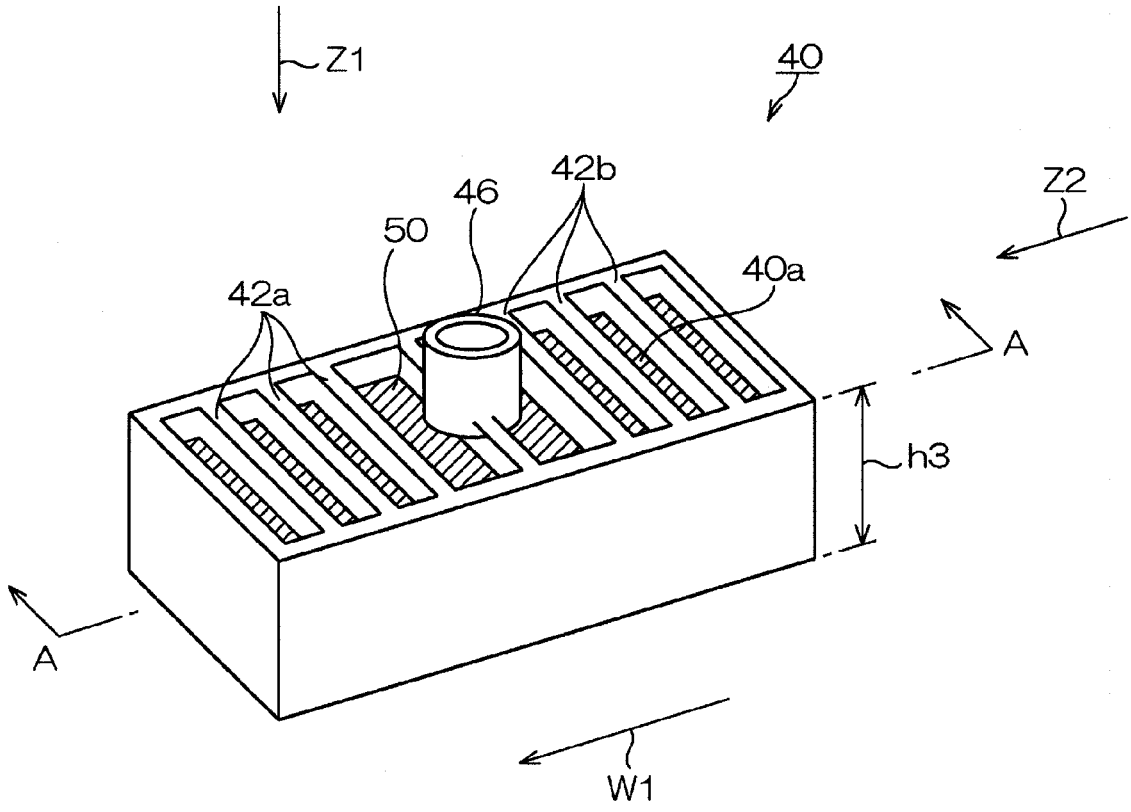
FIG. 2 is a schematic perspective view showing a waste ink tank.

FIG. 2 is a schematic perspective view of the waste ink tank 40.

As shown in FIG. 2, in the waste ink tank 40, a housing that is a main body of the waste ink tank has an outer shape of a substantially rectangular parallelepiped, and has an open face 40*a* opened at its top. Therefore, the ink within the waste ink tank 40 evaporates easily.

Also, the open face 40*a* is provided at a face corresponding to a pump tube outlet 25*a* of the pump tube 25 that is a liquid passage (refer to FIG. 3*a*). As shown in FIG. 2, a cylinder rib 46 is provided on the side of the open face 40*a*.

Also, the waste ink tank 40 has a construction in which an absorbing material 50 is arranged inside the housing. Here, the absorbing material 50 is an example of an absorbing portion that absorbs waste ink.

The waste ink tank 40 is detachably arranged below the suction pump 19 in the recording apparatus 10, and when the absorptive power of the absorbing material 50 is saturated with waste ink, the waste ink tank can be detached in the direction of an arrow W1.

As will be described later, the cylinder rib 46 is adapted to be able to prevent scattering of the waste ink 100 of the pump tube 25, and to force the waste ink 100 remaining within the pump tube 25 to drip into the absorbing material 50 to prevent scattering, when the waste ink tank 40 is detached.

That is, this cylinder rib 46 is an example of a scattering preventing member.

FIGS. 3A to 3C are views showing schematic cross sections of the waste ink tank 40.

FIG. 3A is a schematic sectional view of the waste ink tank 40 taken along the line A-A of FIG. 2. Also, FIG. 3A is a schematic sectional view showing the positional relationship between the waste ink tank 40 and the pump tube 25 in a state where the waste ink tank 40 installed within the recording apparatus 10.

As shown in FIG. 3A, the pump tube 25 is arranged in a position corresponding to the position of the cylinder rib 46 provided in the waste ink tank 40, above the open face of the waste ink tank 40. That is, the pump tube 25 is arranged in a position where the cylinder rib 46 of the waste ink tank 40 is provided, with the waste ink tank 40 installed within the recording apparatus 10. In the present embodiment, as shown in FIG. 3A, the pump tube outlet 25*a* of the pump tube 25 is arranged within the cylinder rib.

Here, as shown in FIG. 3A, the absorbing material 50 is arranged inside the main body of the waste ink tank 40. This absorbing material 50 has a concave absorbing material recess 50*a* substantially in the center of the housing of the waste ink tank 40.

That is, the position of the absorbing material recess 50*a* coincides with a range where the waste ink that has been conducted through the pump tube 25 drips toward the absorbing material 50 from the pump tube outlet 25*a*, with the waste ink tank 40 installed in the recording apparatus 10.

Also, the waste ink 100 dripped into the absorbing material recess 50*a* is dispersed and absorbed into the absorbing material 50, as shown by, for example, arrows P1, P2, and P3.

Further, if the distance between the pump tube outlet 25*a* and the absorbing material 50 that exists on the side of the open face 40*a* of the waste ink tank 40 is short, the pump tube outlet 25*a* may be blocked when the waste ink 100 dripped into the absorbing material 50 is accumulated.

Accordingly, it is preferable that the distance of the pump tube outlet 25*a* to the absorbing material 50 is longer to an extent.

For this reason, with the waste ink tank 40 installed in the recording apparatus 10, the position of the absorbing material recess 50*a* corresponds to the position of the pump tube outlet 25*a* in an upper portion within the open face 40*a* of the waste ink tank 40. For the reason, the distance of the pump tube outlet 25*a* to the absorbing material 50 can be kept somewhat long, and blocking of the pump tube outlet 25*a* by the waste ink 100 can be prevented. The pump tube 25 is formed of, for example, silicone rubber that is a material having flexibility, and is hollowed.

The waste ink tank 40 has the absorbing material pressers 42*a* and 42*b* for fixing the absorbing material 50, and the cylinder rib 46. Although the absorbing material pressers 42*a* and 42*b* fix the absorbing material 50, they are just an example. The cylinder rib 46 may also function to fix the absorbing material 50.

Here, as shown in FIG. 3A, the waste ink 100 may remain the vicinity of the pump tube outlet 25*a* within the pump tube 25. Although not shown, this remaining waste ink 100 may include bubbles, etc. The phenomenon that the waste ink 100 remains in the vicinity of the pump tube outlet 25*a* easily occurs particularly when bubbles are mixed in the waste ink.

FIG. 3B is a schematic plan view when the waste ink tank 40 is seen from the direction of an arrow Z1 of FIG. 2.

As shown in FIG. 3B, the absorbing material pressers 42*a* and 42*b* and the cylinder rib 46 are formed integrally, and are fitted on upper ends of a box constituted by individual walls 41*a*, 41*b*, 41*c*, 41*d*, and 41*e* of the waste ink tank 40, thereby forming a housing that is a waste ink tank body 41 of the waste ink tank 40. FIG. 3C is a schematic view showing the heights of individual portions of the waste ink tank 40. The relationship among the pump tube outlet 25*a*, the absorbing material recess 50*a*, the cylinder rib 46, etc. will be described in more detail using this schematic view.

FIG. 3C shows heights seen from the direction of an arrow Z2 of FIG. 2, and individual heights h1 to h6 are based on a waste ink tank bottom 40*b* (refer to FIG. 3A).

"h1" is a height from the waste ink tank bottom 40*b* to the surface of the absorbing material recess 50*a*, i.e., the surface thereof corresponding to the upper pump tube outlet 25*a* in the drawing.

"h2" is a height from the waste ink tank bottom 40*b* to a face arranged at the open face of the waste ink tank 40 on the side of the surface of the absorbing material 50 other than the absorbing material recess 50*a*.

"h3" is a height (refer to FIG. 2) from the waste ink tank bottom 40*b* to an upper face 41*a*1 of the rear wall (refer to FIG. 3A).

"h4" is a height from the waste ink tank bottom 40*b* to upper faces 42*a*1 and 42*b*1 of the absorbing material pressers 42*a* and 42*b*.

"h5" is a height from the waste ink tank bottom 40*b* to the pump tube outlet 25*a*.

"h6" is a height from the waste ink tank bottom 40*b* to a cylinder rib upper face 46*b* that is the upper face of the cylinder rib 46.

As shown in FIG. 3C, the height h1, etc. are specified so as to satisfy the following Expression 1: $h1<h2<h3\leqq h4<h5<h6$).

The waste ink tank 40 is constructed as described above.

As described above, the relationship between h5 resulting from the pump tube outlet 25*a* and h6 resulting from the height of the cylinder rib 46 is $h5<h6$.

That is, with the waste ink tank 40 installed in the recording apparatus 10, the pump tube outlet 25*a* of the pump tube 25 that is a liquid passage is put into the cylinder rib 46 through the upper face thereof, and the pump tube 25 is arranged to partially overlap the cylinder rib 46. Accordingly, the cylinder rib 46 is provided so as to surround the pump tube 25. In other words, the portion of the pump tube 25 in the vicinity of the pump tube outlet 25*a* is surrounded by an inner peripheral wall face 46*a* of the cylinder rib 46.

Here, description will be made referring to FIG. 4 that is a partially enlarged sectional view showing the relationship between the pump tube 25 and the cylinder rib 46 of FIG. 3A.

Figure 4A:
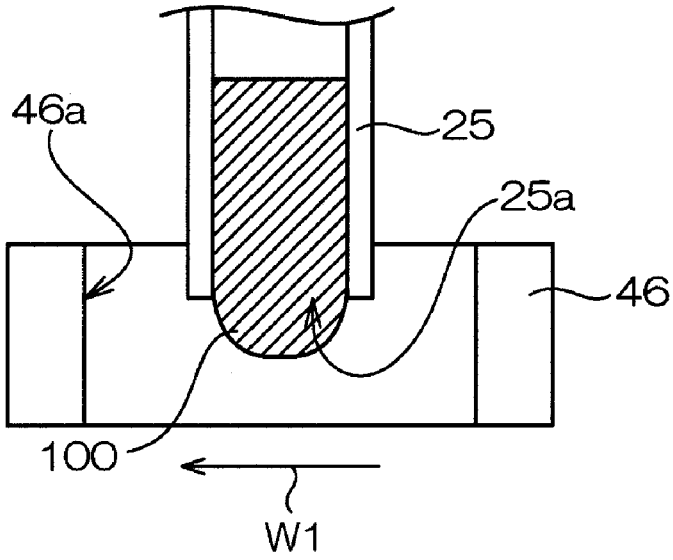
FIGS. 4A and 4B are schematic views showing partial enlarged views of the waste ink tank, etc.
Figure 4B:
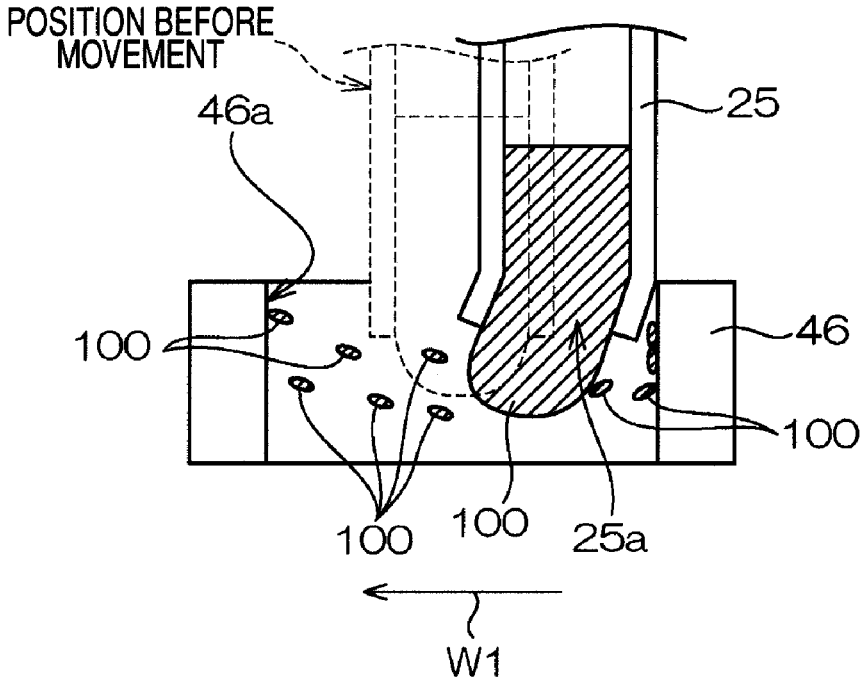

As shown in FIGS. 3A and 4, if the waste ink 100 remains in the pump tube 25, the waste ink tank 40 is moved in the direction of the arrow W1 in order to detach the waste ink tank 40 from the recording apparatus. Then, the pump tube 25 contacts the cylinder rib 46, and gets bent (Refer to FIG. 4B).

This is because the height h6 (refer to FIG. 3C) to the cylinder rib 46 is greater than the height h5 to the pump tube outlet 25*a* as described above.

In other words, the height h6 of the cylinder rib 46 is prescribed so that the cylinder rib may contact the pump tube 25 when the waste ink tank 40 is detached from the recording apparatus 10.

Thereby, the waste ink 100 that has remained in the pump tube 25 is discharged forcibly and removed, as schematically shown in FIG. 4B.

Further, if bubbles are mixed in the waste ink 100, the bubbles in the waste ink 100 hits the inner peripheral wall face 46*a* of the cylinder rib 46, and are burst and scattered. The burst waste ink 100 hits the inner peripheral wall face 46*a* of the cylinder rib 46, is carried along the inner peripheral wall face 46*a* of the cylinder rib 46, and reaches the absorbing material 50 (Refer to FIG. 4B).

Moreover, if bubbles are entrained in the waste ink 100, particularly even if the waste ink 100 are scattered when the waste ink 100 is discharged from the pump tube 25 to the waste ink tank 40, the ink scattered to the cylinder rib 46 hits the inner peripheral wall face 46*a* of the cylinder rib 46, and is carried along the inner peripheral wall face 46*a* of the cylinder rib 46, and reaches and is absorbed by the absorbing material 50.

That is, in order to remove the waste ink 100 remaining in the pump tube 25, the cylinder rib 46 contacts the pump tube 25 to bend the pump tube 25 in order to apply a certain force to the portion of the pump tube in the vicinity of the pump tube outlet 25*a* in which the waste ink 100 remains, thereby applying the force for removing the remaining waste ink 100 to the pump tube 25.

Then, if the waste ink tank 40 is further moved in the direction of the arrow W1, bending of the pump tube 25 will return to normal.

At this time, in the waste ink 10*b* removed from the pump tube 25, the waste ink 100 scattered in the direction of the rear wall 41*a* may not drip into the absorbing material recess 50*a* due to the return of bending of the pump tube 25.

However, even in such a case, the absorbing material presser 42*b* also acts as a wall for catching ink, thereby preventing the scattered waste ink 100 from soiling an outer peripheral wall, etc. of a housing that is a main body itself of the waste ink tank 40 due to further outflow of the ink from the rear wall 41*a*. As such, the absorbing material presser 42*b* arranged between the cylinder rib 46 and the rear wall 41*a* also functions as a wall for catching the waste ink 100.

Then, when the waste ink tank 40 further moves in the direction of the arrow W1, the pump tube 25 is in the relationship of h3<h5 as described above. Thus, the pump tube outlet 25*a* passes above the upper face 41*a*1 of the rear wall without contacting the upper face.

For this reason, a user's hand is not soiled because ink does not adhere to the upper face 41*a*1 of the rear wall, and adhering ink is not carried to the outer peripheral wall face of the waste ink tank 40 to soil it.

Then, after the waste ink tank 40 is detached from the recording apparatus 10, the pump tube outlet 25*a* will not face the waste ink tank 40. However, since the waste ink 100 remaining in the pump tube 25 is already discharged, the waste ink 100 does not fall into the recording apparatus 10 after the waste ink tank 40 is detached. Accordingly, the inside of the recording apparatus 10 is not soiled.

As described above, the height h6 (refer to FIG. 3C) of the cylinder rib 46 is prescribed so that the cylinder rib may contact the pump tube 25 when the waste ink tank 40 is detached from the recording apparatus 10. For this reason, the waste ink 100 remaining in the pump tube 25 that is a liquid passage is forcibly eliminated by the cylinder rib 46 when the waste ink tank 40 is detached from the recording apparatus 10. That is, if the waste ink 100 extruded from the pump tube 25 hits the inner peripheral wall face 46*a* of the cylinder rib 46, and bubbles are entrained in the waste ink, the bubbles are burst and hits the inner peripheral wall face 46*a*, are carried along the inner peripheral wall face 46*a*, and are dripped into and absorbed by the absorbing material 50.

Thereby, when the waste ink tank 40 is detached, or after the waste ink tank 40 is detached, scattering or natural falling of the waste ink remaining in the pump tube 25 can be prevented. Moreover, if bubbles are entrained in the waste ink 100, or if the apparent amount of the waste ink 100 is increasing, the cylinder rib 46 functions as a scattering prevention means to catch the waste ink 100 having bubbles entrained, to thereby prevent the ink from being scattered. Also, the dripped ink is carried along the inner peripheral wall face 46*a* of the cylinder rib 46, and is led to the absorbing material 50. Accordingly, the cylinder rib 46 also functions as an introducing dripping portion to lead waste ink to an absorbing material.

Moreover, the cylinder rib 46 can also be made to function as a fixing means that is required to fix the absorbing material 50 to the waste ink tank 40.

Second Embodiment

Next, a second embodiment will be described. Since the second embodiment has many structural elements that are common to the first embodiment, the common elements are denoted by the same reference numerals, and following description will be made mainly about points different from the first embodiment.

Figure 5:
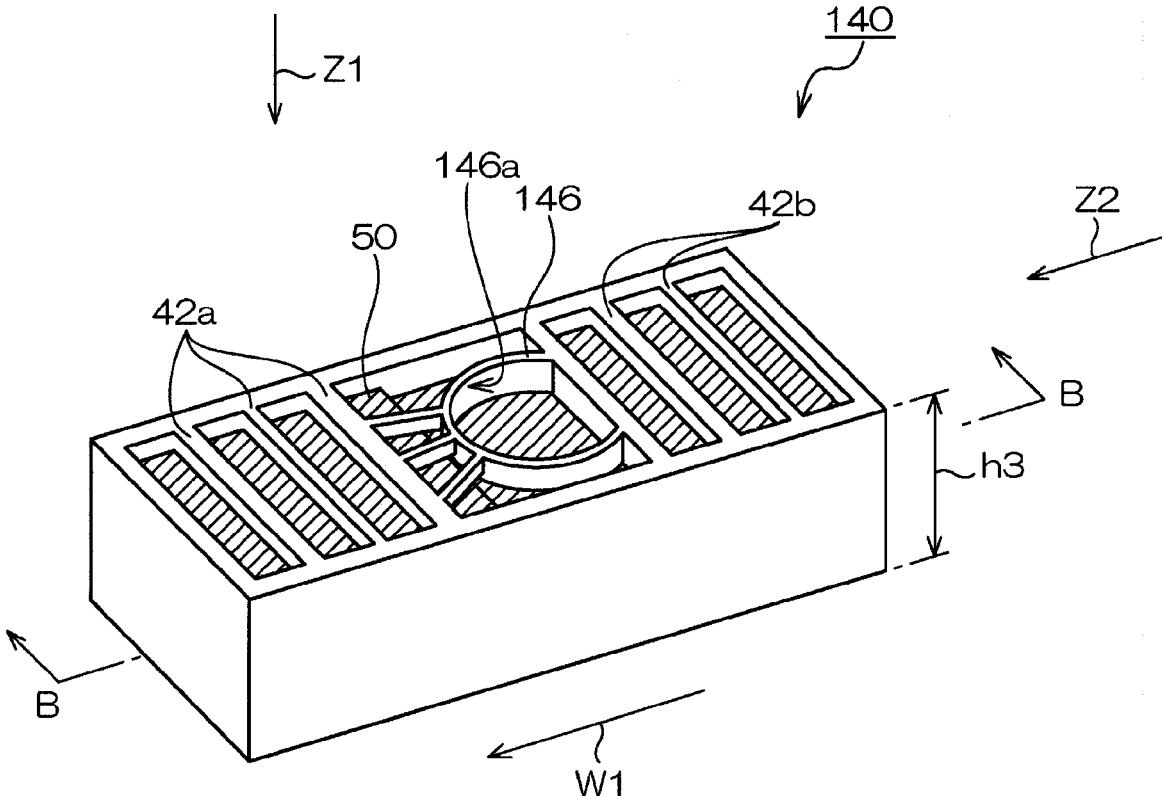
FIG. 5 is a schematic perspective view showing the waste ink tank.

FIG. 5 is a schematic perspective view of a waste ink tank 140.

Figure 6A:
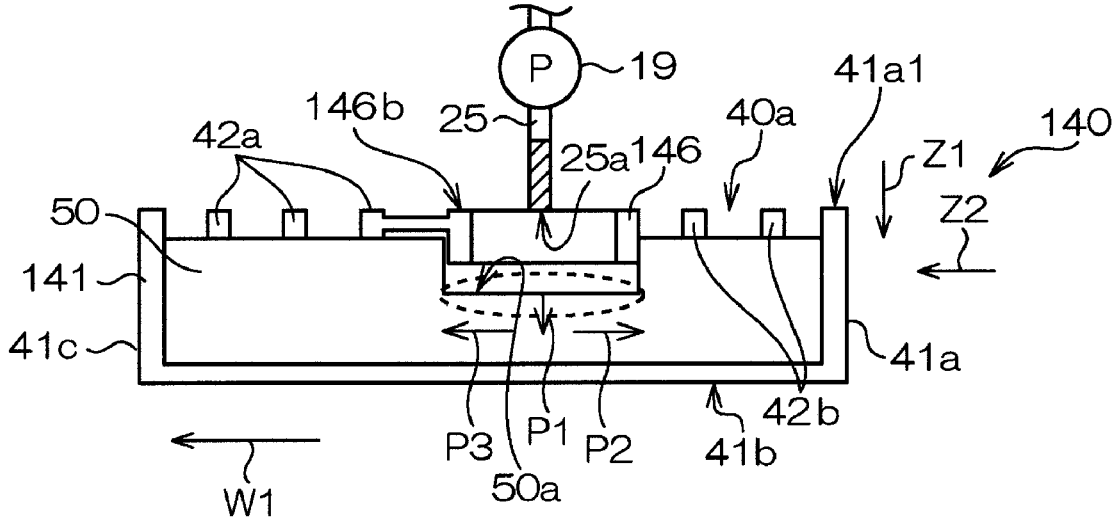
FIGS. 6A and 6B are schematic views showing cross sections of the waste ink tank.

FIG. 6A is a schematic sectional view of the waste ink tank 140 taken along the line B-B of FIG. 5.

As shown in FIG. 6A, the pump tube outlet 25*a* is arranged so as to be located in almost the same surface with an upper face 146*b* of a scattering prevention rib 146.

Figure 6B:
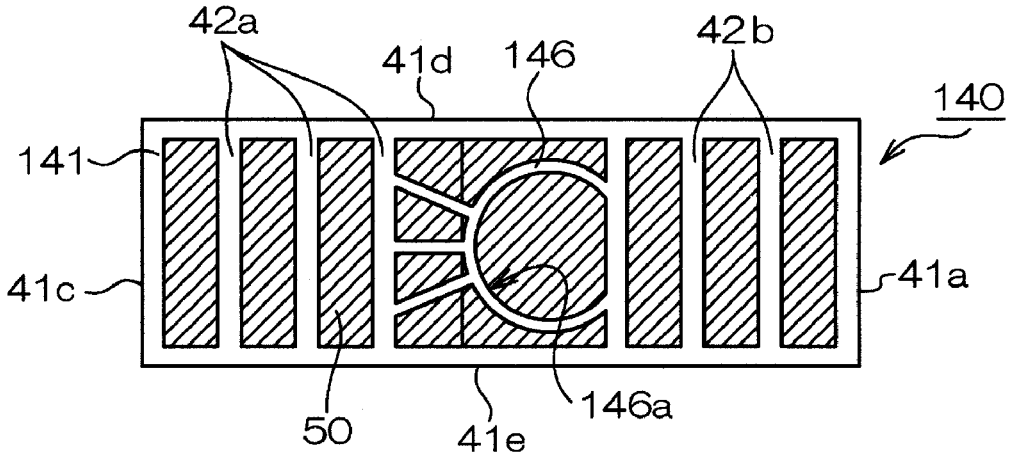

FIG. 6B is a schematic plan view when the waste ink tank 140 is seen from the direction of an arrow Z1 of FIG. 5.

As shown in FIG. 6B, the absorbing material pressers 42*a* and 42*b* and the scattering prevention rib 146 are formed integrally, and are fitted on upper ends of a box constituted by individual walls 41*a*, 41*b*, 41*c*, 41*d*, and 41*e* of the waste ink tank 140, thereby forming a housing that is a waste ink tank body 141 of the waste ink tank 140. If bubbles are entrained in the waste ink 100 remaining in the pump tube 25, the waste ink 100 may overflow from the pump tube outlet 25*a*.

In such a case, if the waste ink tank 140 is moved in the direction W1 in order to detach the waste ink tank 140 from the recording apparatus 10, the bubbles entrained in the waste ink 100 may be burst and scattered, or be pulled to the pump tube 25. Therefore, there is a possibility of soiling the surroundings of the waste ink tank 140.

Figure 7A:
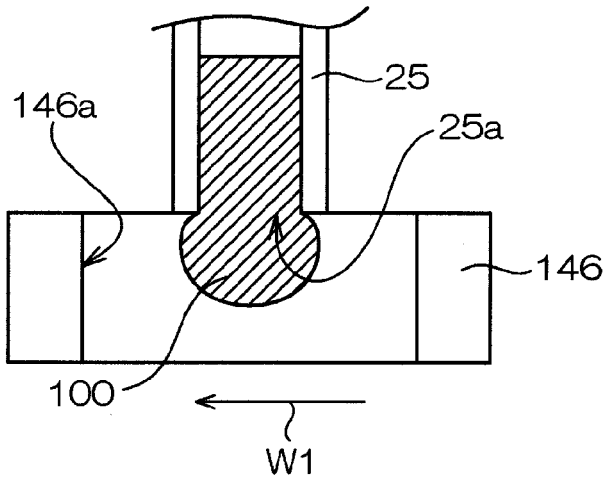
FIGS. 7A and 7B are schematic views showing partial enlarged views of the waste ink tank, etc.
Figure 7B:
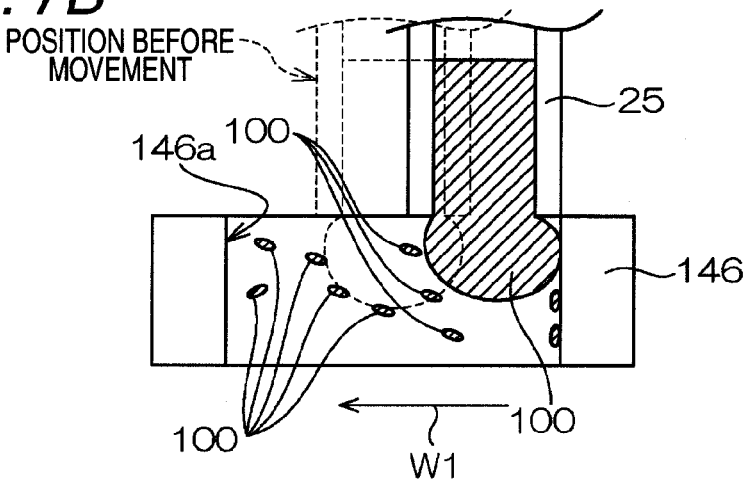

Accordingly, when the waste ink tank 140 moves in the direction of the arrow W1 in order to prevent such a phenomenon, the pump tube contacts the scattering prevention rib 146 whereby the waste ink 100 is eliminated by the scattering prevention rib 146, is carried along an inner peripheral wall face 146*a* of the scattering prevention rib 146, and reaches the absorbing material 50 (refer to FIGS. 6A, 7A, and 7B).

If bubbles are entrained in the waste ink 100, the inner peripheral wall face 146*a* of the scattering prevention rib 146 functions as a catching portion when the bubbles are burst and scattered.

Here, FIG. 7A is a partially enlarged sectional view showing the relationship among the scattering prevention rib 146, pump tube 25, pump tube outlet 25*a*, and waste ink 100 in FIG. 6A. Also, FIG. 7B is a schematic explanatory view showing a state where the waste ink tank 140 has been moved in the detachment direction W1, in the partially enlarged sectional view shown in FIG. 7A.

Further, if bubbles are entrained when the waste ink 100 is discharged from the pump tube 25, the amount of the waste ink may increase and the ink may overflow from the absorbing material 50. Even in such a case, thanks to existence of the scattering prevention rib 146, the discharged waste ink 100 is caught within the scattering prevention rib 146, and does not overflow. That is, if the waste ink tank 140 is arranged in the recording apparatus 10, the scattering prevention rib 146 exists in correspondence with the position of the pump tube outlet 25*a* of the pump tube 25. The scattering prevention rib 146 is provided in a position corresponding to the position where the cylinder rib 46 of the waste ink tank 40 of the first embodiment is provided.

Accordingly, the scattering prevention rib 146 is located in the position where the waste ink 100 is discharged and dripped, it functions as a catching portion when the waste ink 100 are scattered.

Here, if the heights of individual portions of the waste ink tank 140 are described, a point different from the first embodiment is the relationship between h5 and h6 in FIG. 3C.

In the second embodiment, as described referring to FIGS. 6B and 7, if the scattering prevention rib 146 is used instead of the cylinder rib of h6 in a height seen from the direction of an arrow Z2 of FIG. 6A, h6 indicates a height from the waste ink tank bottom 41*b* to the upper face of the scattering prevention rib 146.

Also, there exists a difference in that the height h6 to the upper face of the scattering prevention portion and the height h5 to the pump tube outlet 25*a* of the pump tube 25 become the relationship of h5=h6.

That is, in the above Expression 1 showing the height relationship in the first embodiment, the heights in the waste ink tank 146 are specified so as to satisfy the following Expression: $h1<h2<h3\leqq h4<h5=h6$).

Even in such relationship, scattering of the waste ink 100 of the pump tube 25 can be prevented as described above.

Figure 8:
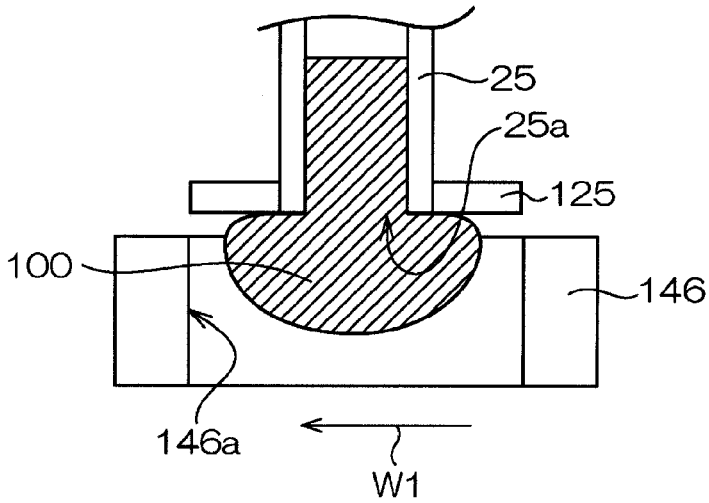
FIG. 8 is a schematic view showing a partial enlarged view of a modified example of the waste ink tank, etc.

Further, FIG. 8 shows a modified example of the second embodiment. FIG. 8 is a partially enlarged sectional view showing the relationship between the pump tube 25 and the scattering prevention rib 146. This modified example is different from the second embodiment in that a pump tube attachment plate 125 is provide in the pump tube outlet 25*a*. Since the other structural elements are the same as those of the first embodiment, detailed description thereof is omitted herein.

The pump tube attachment plate 125 functions to fix the pump tube outlet 25*a*. Thus, any scattering when the waste ink 100 is discharged from the pump tube 25 is prevented, and the portion of the pump in the vicinity of the pump tube outlet 25*a* is prevented from being soiled. However, if the pump tube attachment plate 125 is provided on one side and bubbles are entrained in the waste ink 100, the waste ink 100 may spread toward the pump tube attachment plate 125.

However, even in such a case, since the scattering prevention rib 146 is provided, neither the inside of the recording apparatus 10 nor the surroundings of the waste ink tank 141 are soiled with the waste ink 100.

That is, even if the waste ink 100 has spread in the pump tube attachment plate 125 in this manner, this scattering prevention rib 146 will cause the waste ink 100 in the vicinity of the pump tube attachment plate 125 to hits the scattering prevention rib 146 when the waste ink tank 141 is moved in the direction W1 when the waste ink tank 141 is detached from the recording apparatus 10. Also, the waste ink 100 hits the inner peripheral wall face 146*a* of the scattering prevention rib 146. Then, the waste ink having bubbles burst is carried to the peripheral wall face 146*a*, and is led to the absorbing material 50.

Accordingly, since the waste ink 100 can be removed, there is no possibility of soiling the surroundings due to scattering thereto.

In the embodiment of the invention, the cylinder rib 46 or scattering prevention rib 146 may have a well shape, a rectangular shape, a triangular shape, or an elliptical shape other than the illustrated shape, and may have such a height that scattering of the waste ink 100 is prevented and ink is led to the absorbing material 50. Also, the absorbing material, and a scattering prevention portion that prevent scattering of ink, like the cylinder rib 46, and the scattering prevention rib 146, may be brought into contact with or separated from each other. Further, the above scattering prevention portions may be formed integrally with the housing, etc. of the waste ink tank, or may be formed separately.

The invention is not limited to the above embodiments as a recording apparatus, but various changes may be made without departing from the scope of the claims. Moreover, the above-mentioned embodiments are combined together. Further, the invention is not limited to the recording apparatus, and may be applied to liquid ejection apparatuses using liquid ejection heads that eject liquid, such as a recording head used for an image recording apparatus, such as a printer, a color material ejection head used to manufacture color filters of a liquid crystal display, etc., an electrode material ejection head used to form electrodes of an organic EL display, a surface emission display (FED), etc., and a living body organic matter ejection head used to manufacture biochips, a sample ejection apparatus as a precision pipette, and the like.

Third Embodiment

Figure 9:
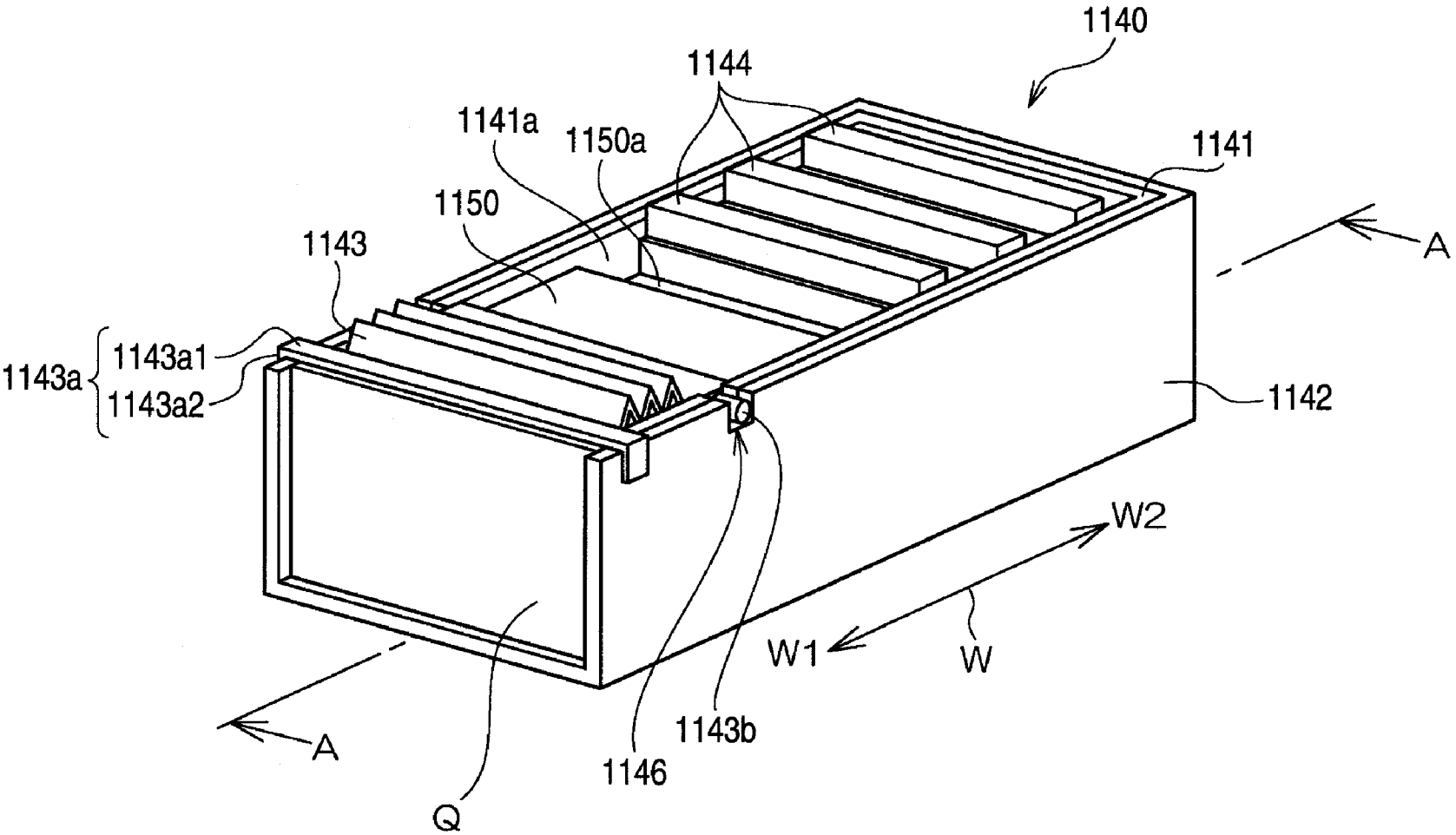
FIG. 9 is a schematic perspective view showing the waste ink tank.

Next, a third embodiment will be described. FIG. 9 is a schematic perspective view showing the waste ink tank 1140 of the third embodiment. The waste ink tank 1140 is detached from the recording apparatus 10 for replacement when the absorptive power of the waste ink of the absorbing material 1150 is saturated.

That is, the waste ink tank 1140 is detachably arranged below the suction pump 19 in the recording apparatus 10. Also, the waste ink tank 1140 can be detached in the direction of the arrow W1 when the absorptive power of the waste ink of the absorbing material 1150 is saturated.

Figure 10:
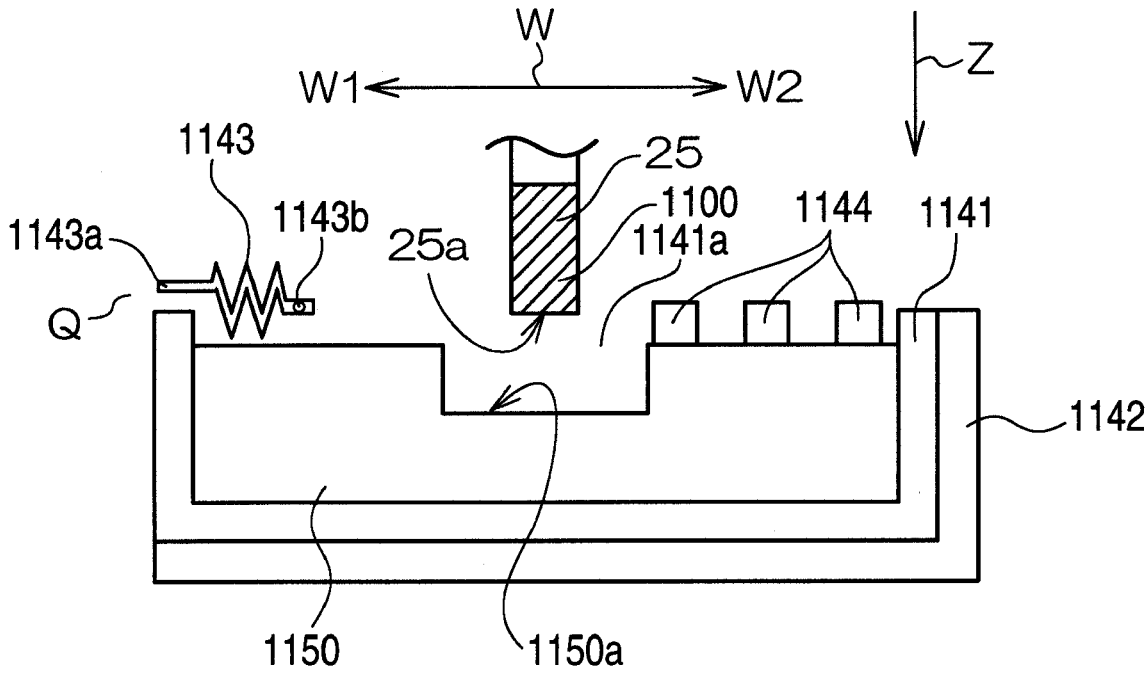
FIG. 10 is a schematic view showing the end face, etc. of the waste ink tank.

As shown in FIG. 9, the waste ink tank 1140 is formed in the shape of a substantially rectangular parallelepiped. As shown in FIGS. 9 and 10, a housing 1141 that is an example of a housing portion having an opening 1141*a* on the side of the outlet 25*a* that is the facing side of the tube 25 that is an example of a guide portion, i.e. on the side where the ink guided from the tube 25 is discharged is provided, and an absorbing material 1150 that is an example of an absorbing member that absorbs ink is arranged inside the housing 1141.

Here, the pump tube 25 is formed of, for example, silicone rubber that is a material having flexibility, and is hollowed.

The absorbing material 1150 has a concave portion 1150*a* in the vicinity of the central portion thereof. The space between the surface of the concave portion 1150*a* located on the side where the waste ink 1100 is caught, i.e., on the side of the opening 1141*a*, and the surface of the tube 25 on the side of the outlet 25*a* is made larger than the space with the surface of the absorbing material 1150 other than the concave portion 1150*a*.

That is, if the waste ink tank 1140 is attached to the recording apparatus 10, the outlet 25*a* of the tube 25 is located in almost the center of the waste ink tank 1140 (refer to FIG. 10).

When the waste ink tank 1140 is detached from the recording apparatus 10, the waste ink tank 1140 is moved in a direction away from the tube 25. That is, the waste ink tank is moved, for example, in a direction W1 of a movement direction W on the drawing.

If the waste ink tank 1140 is moved in a direction away from the tube 25, which is the direction W1, the waste ink 1100 remaining in the outlet 25*a* of the tube 25 needs to be absorbed by the absorbing material 1150 so as not to soil the inside of the recording apparatus 10. For this reason, the waste ink tank 1140 has an ink removing member 1144 for allowing the absorbing material 1150 to absorb such waste ink 1100 that exists in the vicinity of the outlet 25*a* of the tube 25. The ink removing member 1144 is an example of a removing member.

The ink removing member 1144 is provided so as to be exposed through the opening 1141*a*. That is, the ink removing member is exposed through the opening 1141*a* provided on the side facing the outlet 25*a* of the tube 25.

Further, the ink removing member 1144 is provided on the side away from a taking-out position when the waste ink tank 1140 is taken out of the recording apparatus 10. That is, the ink removing member is provided on the side of a direction W2 in the direction W on the drawing. That is, when the waste ink tank 1140 is taken out of the recording apparatus 10 centering on the tube 25, the ink removing member 1144 gradually approach the tube 25. Then, if the absorbing portion is allowed to absorb the waste ink 1100 remaining in the vicinity of the outlet 25*a* of the tube 25, the ink removing member is provided in a position apart from the tube 25.

Accordingly, when the waste ink tank 1140 is detached from the recording apparatus 10, the outlet 25*a* of the tube 25 hits the ink removing member 1144, thereby removing the waste ink 1100 remaining inside the tube 25.

More specifically, if the waste ink 1100 remaining in the vicinity of the outlet 25*a* of the tube 25 hits the ink removing member 1144, the waste ink 1100 will be discharged from the tube 25. Then, the waste ink 1100 is carried along the ink removing member 1144, is guided to the absorbing material 1150, and is absorbed by the absorbing material 1150. For this reason, since the waste ink 1100 remaining in the vicinity of the outlet 25*a* of the tube 25 is removed, when the waste ink tank 1140 is taken out of the recording apparatus 10, the inside of the recording apparatus 10 is not soiled with the waste ink 1100.

The opening 1141*a* of the housing 1141 of the waste ink tank 1140 is formed on the side facing the outlet 25*a* of the tube 25 so that the waste ink 1100 that is guided from the tube 25 and discharged by the absorbing material 1150 can be absorbed by the absorbing material 1150, and is adapted to easily evaporate the waste ink 1100 absorbed by the absorbing material 1150. Further, the opening 1141*a* allows the ink removing member 1144 for removing the waste ink 1100 remaining in the vicinity of the outlet 25*a* of the tube 25 to be exposed to remove the waste ink 1100, thereby making it hard to soil the inside of the recording apparatus 10.

Further, the ink removing member 1144 fixes the absorbing material 1150 to the waste ink tank 1140.

Further, the waste ink tank 1140 is provided with a cover member 1143 as a covering member that covers the ink removing member 1144 so that the ink removing member 1144 exposed through the opening 1141*a* can prevent a user and the like from being soiled during replacement of the waste ink tank 1140.

Here, the cover member 1143 is folded and housed at one end of the waste ink tank 1140, i.e., in a position apart from the tube 25, in a state where the waste ink tank 1140 is attached to the recording apparatus 10. The above "position apart" means a side opposite to the side where the ink removing member 1144 of the waste ink tank 1140 is provided. Also, the cover member 11431 is unfolded so as to cover the ink removing member 1144 when the waste ink tank 1140 is taken out of the recording apparatus 10.

While the waste ink tank 1140 is used, that is, in a state the waste ink tank is attached to the recording apparatus 10, the ink removing member 1144 is exposed through the opening 1141*a*.

Also, when the waste ink tank 1140 is detached, the cover member 1143 can be unfolded to cover the ink removing member 1144. Therefore, since a user and the like do not directly touch the ink removing member 1144 during replacement, the user and the like are not soiled with waste ink.

More detailed description will be made referring to FIGS. 10 to 14.

FIGS. 10 to 14 show a state where the waste ink tank 1140 is moved in the direction W1 of the direction W, and are views for explaining the state of the cover member 1143 when the waste ink tank is detached.

FIG. 10 is a schematic end view cut along the line A-A of FIG. 9, and shows the relationship with the tube 25 that is not shown in FIG. 9.

Figure 11:
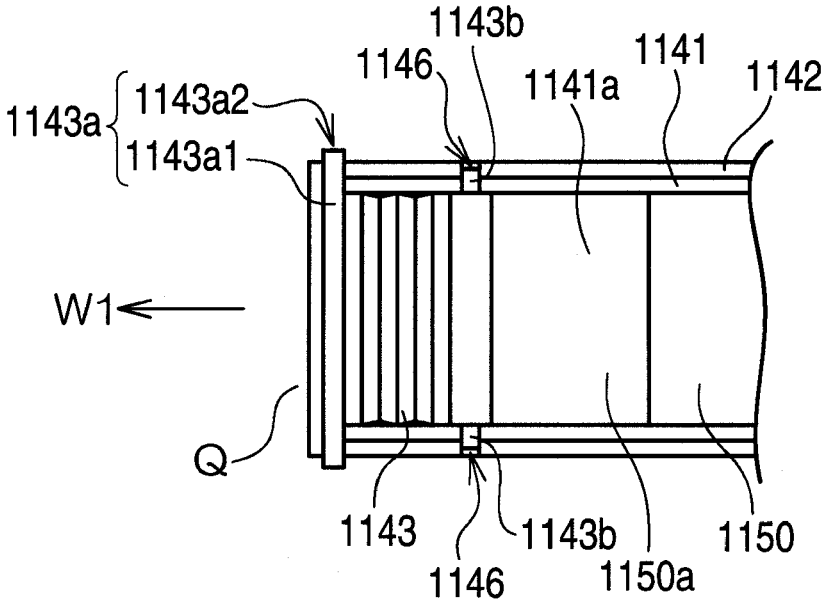
FIG. 11 is a schematic view showing the partial upper face of the waste ink tank.

FIG. 11 is a partial schematic top view of FIG. 10, that is, a partial schematic top view of the waste ink tank 1140 when the waste ink tank 1140 is seen from a direction in which the tube 25 is provided. FIG. 10 is a view as seen from the direction Z.

Figure 12:
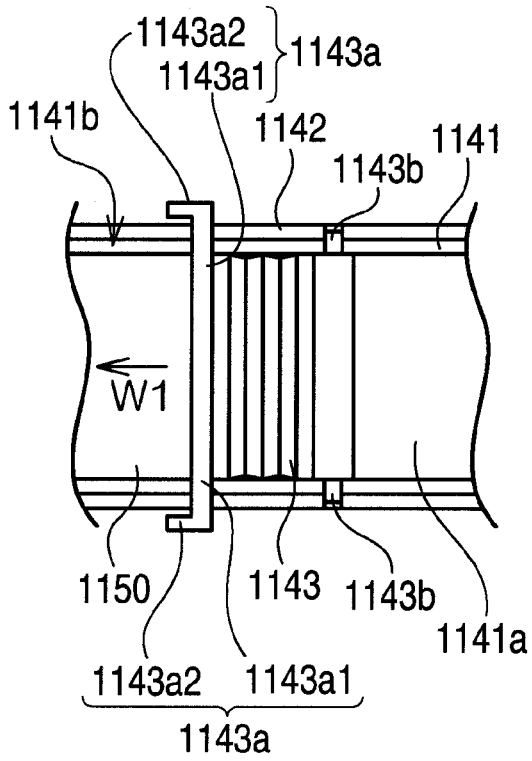
FIG. 12 is a schematic view showing the partial upper face of the waste ink tank.

Also, FIG. 12 shows a case where the waste ink tank 1140 has been moved in the direction W1 of the direction W of FIG. 10, that is, a state where the waste ink tank 1140 is moved so as to be detached from the recording apparatus 10 when the waste ink tank 1140 is replaced, and is a partial schematic top view of the waste ink tank 1140.

Figure 13:
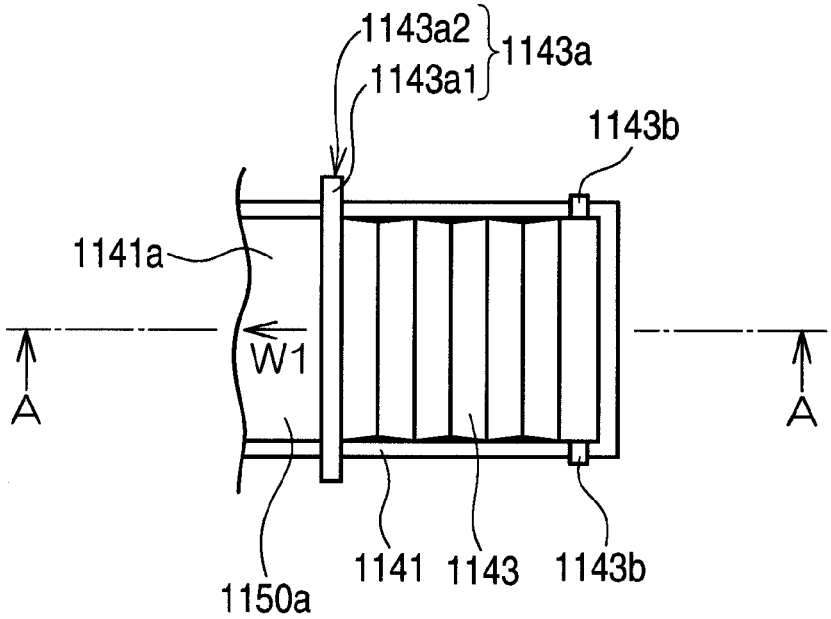
FIG. 13 is a schematic view showing the partial upper face of the waste ink tank.

Also, FIG. 13 is a partial schematic top view of the waste ink tank 1140 showing a state where the waste ink tank 1140 has been detached from the recording apparatus 10.

Figure 14:
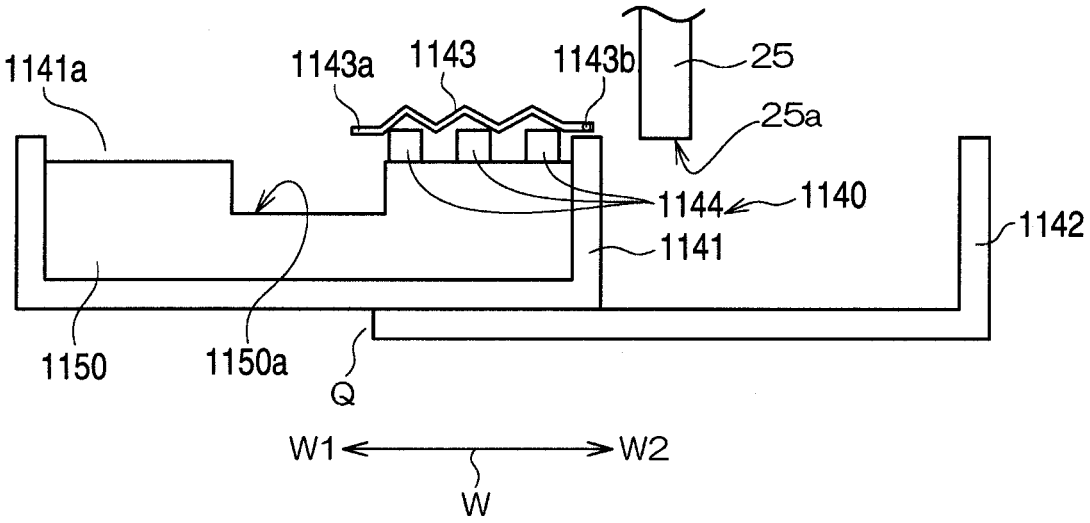
FIG. 14 is a schematic view showing the end face, etc. of the waste ink tank.

Also, FIG. 14 is a schematic end view cut along the line A-A in the state of FIG. 13, i.e., a schematic end view corresponding to the schematic end view cut along the line A-A of FIG. 9. More specifically, FIG. 14 shows a state where the waste ink tank 1140 has been moved to a detachment position by moving the waste ink tank 1140 in a detachment direction from the state of FIG. 10.

In the state of FIGS. 10 and 11, when the waste ink tank 1140 is attached to the recording apparatus 10 and is used, the cover member 1143 is folded and housed in the vicinity of an entrance Q that is a replacement opening for the waste ink tank in the recording apparatus 10 corresponding to the attachment/detachment position of the waste ink tank 1140 at one end of the waste ink tank 1140.

In the initial state, for example, one end of the cover member 1143 can be locked in the vicinity of the entrance Q for the waste ink tank 1140 of a waste ink tank holding unit 1142 that sets the housing 1141 of the waste ink tank 1140. For example, a locking unit 1143*a* is provided at one end of the cover member 1143 so that it can be locked to the waste ink tank holding unit 1142. The locking unit 1143*a* has, for example, a belt-like bridging portion 1143*a*1 that is bridged in a lateral direction of the opening 1141*a* of the waste ink tank 1140, bent portions 1143*a*2 that are formed by downwardly bending both ends of the bridging portion, i.e., portions hooked to the waste ink holding unit 1142, and the like.

The locking unit 1143*a* is locked in the vicinity of the entrance for the waste ink tank 1140 of the waste ink tank holding unit 1142 by the bridging portion 1143*a*1, and the bent portion 1143*a*2. For example, in order for the bent portion 1143*a*2 to be locked in the vicinity of the entrance for the waste ink tank 1140 of the waste ink tank holding unit 1142, the vicinity of the entrance for the waste ink tank 1140 of the waste ink tank holding unit 1142 may be provided with a locking groove (not shown), etc. such that a tip of the bent portion 1143*a*2 is hooked to the locking groove, or may be provided with a locking projection (not shown) such that the bent portion 1143*a*2, etc. is abutted on and stopped by the locking projection. Locking may be made so that the cover member 1143 may be folded and housed in this position, or locking may be changed to different methods other than the locking unit 1143*a*.

For example, the other end of the cover member 1143 is provided with a stopper portion 1143*b*. In a state where the waste ink tank 1140 is used, which is the position of FIGS. 10 and 11, the stopper portion 1143*b* is provided with a groove 1146 that connects the housing 1141 of the waste ink tank 1140 and the waste ink tank holding unit 1142, and the stopper portion 1143*b* is installed in the groove 1146.

The groove 1146 is not particularly limited if the cover member 1143 is folded and housed during use.

Next, as shown in FIG. 12, in order to detach the waste ink tank 1140, the waste ink tank 1140 is moved in the direction W1.

At this time, the above-mentioned locking unit 1143*a* of the cover member 1143 releases the locking with the waste ink tank holding unit 1142. For example, the end of the bent portion 1143*a*2 that has been directed downward is released such that the end is directed slightly upward and laterally. The stopper 1143*b* of the other end of the cover member 1143 is also released, thereby moving the waste ink tank 1140 such that the stopper 1143*b* runs along a housing end 1141*b* on the side where the opening 1141*a* of the housing 1141 of the waste ink tank 1140 is provided. In this case, if the cover member 1143 itself is not moved much, but the waste ink tank 1140 is moved, the waste ink 1100 remaining in the vicinity of the outlet 25*a* of the tube 25 can be smoothly removed by the ink removing member 1144 as described above when the waste ink tank is moved in the direction W1 that is the taking-out direction of the waste ink tank 1140.

Next, as shown in FIGS. 13 and 14, the cover member 1143 is locked to the housing 1141 of the waste ink tank 1140 in the vicinity of the entrance Q for the waste ink tank 1140 of the waste ink tank holding unit 1142 when the waste ink tank 1140 is taken out. That is, since the waste ink tank 1140 moves in the direction W1, the ink removing member 1144 of the waste ink tank 1140 approaches the vicinity of the entrance Q that is the replacement opening for the waste ink tank 1140 of the waste ink tank holding unit 1142. Thus, the cover member is locked to the housing 1141 of the waste ink tank 1140 in this position. Then, the cover member 1143 can be unfolded so as to cover the ink removing member 1144.

Then, in this state, the waste ink tank 1140 is detached from the recording apparatus 10 and is replaced with the other.

That is, the waste ink tank 1140, i.e., the waste ink tank 1140 that is an example of a liquid storage portion of the recording apparatus 10 that is an example of an liquid ejection apparatus that absorbs and stores the waste ink 1100 that is an example of the liquid discharged from the tube 25 that is an example of a guide portion that guides the ink discharged from the recording head 30 to the absorbing material 1150 that is an example of an absorbing member, using the absorbing material 1150, has the housing 1141 that has the opening 1141*a* on the side facing the tube 25, the absorbing material 1150 arranged within the housing 1141, and the ink removing member 1144 that is an example of a removing member for removing the waste ink 1100 remaining in the vicinity of the outlet 25*a* of the tube 25, when the recording head 30 that is an example of a liquid ejection head that ejects the ink that is an example of liquid is cleaned, and has the cover member 1143 that is an example of a covering member that covers the ink removing member 1144 serving as an example of a removing member housing mechanism that houses the ink removing member 1144 so as not to be exposed through the opening 1141*a*, when the waste ink tank 1140 is detached from the recording apparatus 10.

Accordingly, according to the construction of the waste ink tank 1140 as described above, when the waste ink tank 1140 is detached from the recording apparatus 10, the waste ink 1100 remaining in the vicinity of the outlet 25*a* of the tube 25 is removed in advance by the ink removing member 1144, and is dripped into and absorbed by the absorbing material 1150. Therefore, the inside of the recording apparatus 10 is prevented from being soiled due to scattering or natural fall of the waste ink 1100 remaining in the vicinity of the outlet 25*a* of the tube 25. Furthermore, since the ink removing member 1144 is covered with the cover member 1143 that is an example of a covering member serving as a removing member housing mechanism that prevents the ink removing member from being exposed through the opening 1141*a*, a user and the like are not soiled by the waste ink tank 1140 when or after the waste ink tank 1140 is detached.

Also, when the cover member 1143 is attached to the recording apparatus 10 and is used, the waste ink tank 1140 is folded and housed in a position of the attachment direction of the waste ink tank 1140, i.e., in the vicinity of the entrance Q of the waste ink tank holding unit 1142 of the waste ink tank 1140. In other words, the cover member 1143 is folded and housed in the vicinity of the end of the waste ink tank 1140 that is not close to the tube 25. Also, when the waste ink tank 1140 is detached from the recording apparatus 10, the cover member is unfolded in a position where the ink removing member 1144 is installed, so that the ink removing member 1144 can be covered.

Accordingly, when the waste ink tank 1140 is attached to the recording apparatus 10 and is used, the housing space of the cover member 1143 can be made small. Also, when the waste ink tank 1140 is detached from the recording apparatus 10, the cover member is unfolded in the position of the ink removing member 1144. Thus, the ink removing member 1144 can be covered sufficiently. For this reason, a user and the like are not soiled when the liquid storage portion is replaced.

Fourth Embodiment

Next, a fourth embodiment of the invention will be described with reference to FIGS. 15 to 19.

In the fourth embodiment, constructional elements that are common to those of the third embodiment are denoted by the same reference numerals, and the description thereof is omitted, and the following description will be made mainly about different portions.

Figure 15:
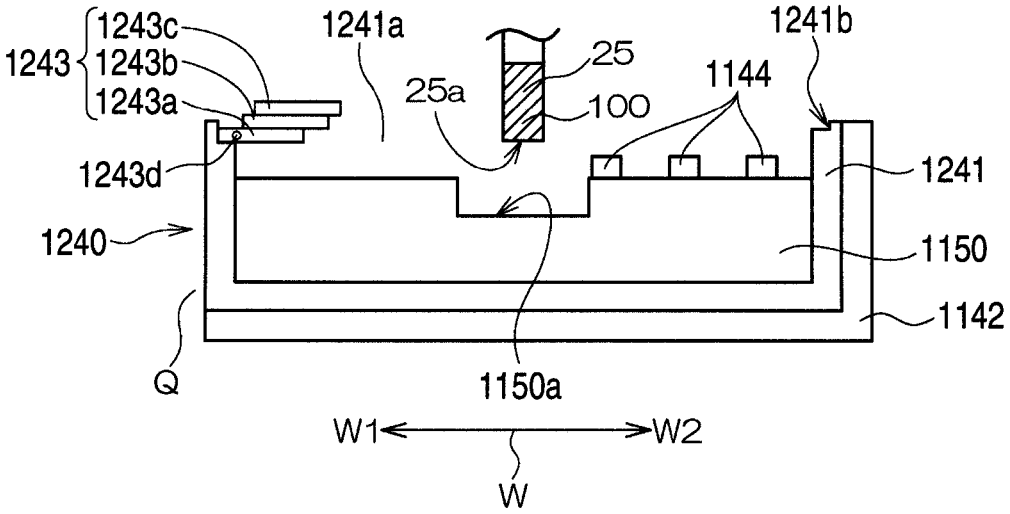
FIG. 15 is a schematic view showing the end face, etc. of the waste ink tank.
Figure 16:
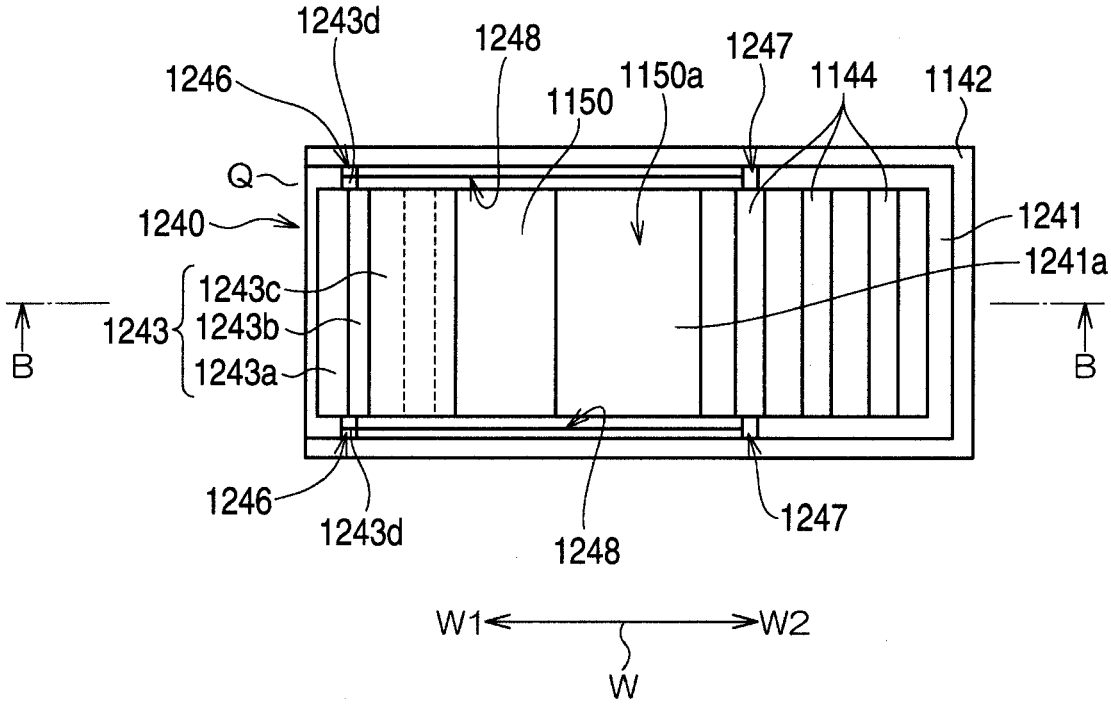
FIG. 16 is a schematic view showing the upper face of the waste ink tank.

FIG. 15 is a schematic end view of a waste ink tank 1240, and shows a schematic end view taken along the line B-B in a schematic top view of the waste ink tank 1240 shown in FIG. 16. The positional relationship among the tube 25, split cover member 1243, and waste ink tank 1240 in the recording apparatus 10 is shown. FIG. 16 is a schematic top view of the waste ink tank 1240, and shows a schematic top view as seen from the direction of the tube 25 in FIG. 15.

Figure 17:
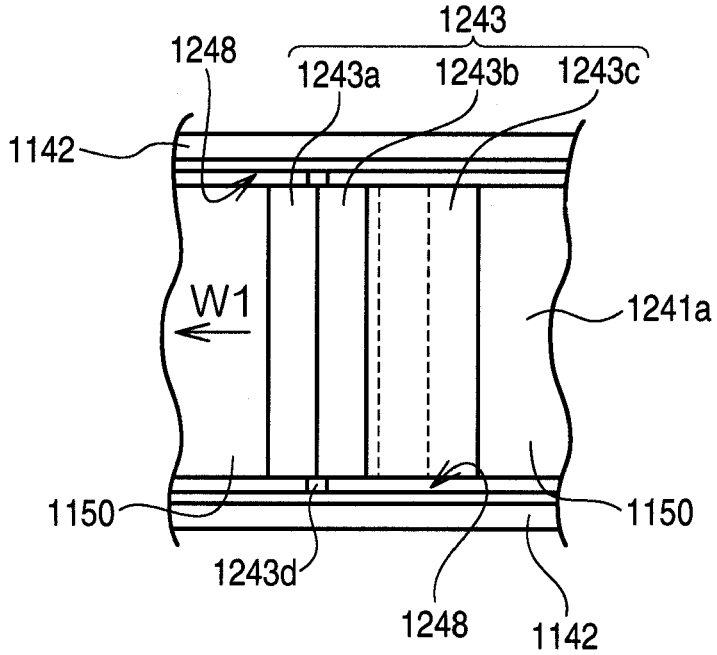
FIG. 17 is a schematic view showing the partial upper face of the waste ink tank.

FIG. 17 is a partial schematic top view showing an intermediate course in a case where the waste ink tank is being moved in the direction W1 that is the detachment direction of the waste ink tank 1240 when the waste ink tank 1240 is detached from the recording apparatus 10. The positional relationship between the waste ink tank 1240 and the split cover member 1243 is shown.

Figure 18:
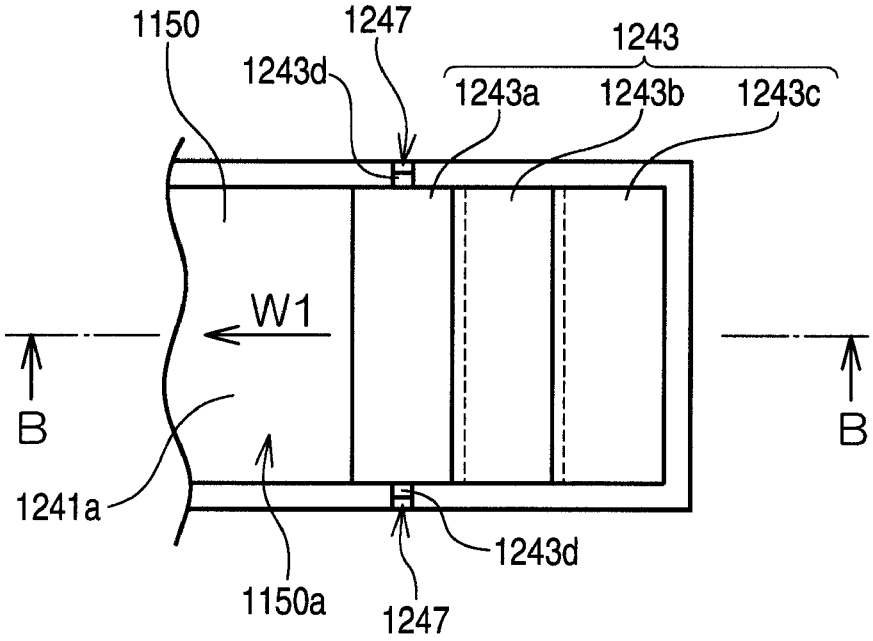
FIG. 18 is a schematic view showing the partial upper face of the waste ink tank.

FIG. 18 is a partial schematic top view showing the relationship between the waste ink tank 1240 and the split cover member 1243 when the waste ink tank 1240 is located in the vicinity of the outlet of the waste ink tank holding unit 1142, i.e., the waste ink tank is spaced from the tube 25, when the waste ink tank 1240 is detached from the recording apparatus 10.

Figure 19:
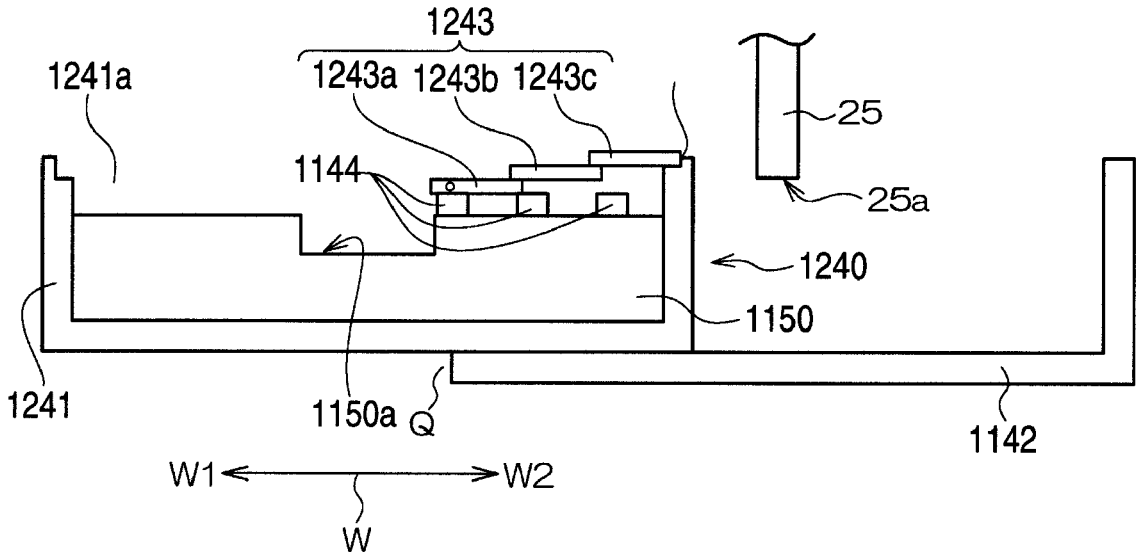
FIG. 19 is a schematic view showing the end face, etc. of the waste ink tank.

Also, FIG. 19 is a schematic end view taken along the line B-B line of FIG. 18, and shows the positional relationship among the tube 25, the waste ink tank 1240, the split cover member 1243, and the like.

Here, similarly to the third embodiment, the waste ink tank 1240 has the ink removing member 1144, the inside of the waste ink tank 1240 is provided with the absorbing material 1150, and the substantially central portion of the absorbing material 1150 is provided with the concave portion 1150*a*. The function of each of them is the same as that described in the third embodiment.

In addition, the waste ink tank 1240 is an example of a liquid storage portion.

As shown FIGS. 15 and 16, the waste ink tank 1240 has the split cover member 1243. The split cover member 1243 is split into three pieces like a first cover member 1243*a*, a second cover member 1243*b*, and a third cover member 1243*c*, and is housed at one end of the waste ink tank 1240. The housing position of the split cover member 1243 is in the vicinity of the end of the waste ink tank 1240 that is not near to the tube 25, when the waste ink tank 1240 is attached to the recording apparatus 10. On the drawing, the housing position is in the vicinity of the direction W1 in the waste ink tank 1240. Further, this position is also in the vicinity of the entrance Q for the waste ink tank 1240 of the waste ink tank holding unit 1142 when the waste ink tank 1240 is attached to the recording apparatus 10.

In the housing position of the split cover member 1243, the split cover member 1243 is split into the first to third cover members 1243*a*, 1243*b*, and 1243*c*, and is housed. These cover members 1143*a*, 1243*b*, and 1243*c* are housed such that they partially overlap each other. The first cover member 1243*a* that is in a position most apart from the tube 25 in the direction W1 of the waste ink tank 1240 has an engaging portion 1243*d* that engages an end of the waste ink tank 1240 on the side of an opening 1241*a* of a housing 1241.

Also, a first engagement groove 1246 that engages the engaging portion 1243*d* is provided at the end of the waste ink tank 1240 on the side of the opening 1241*a* of the housing 1241 in the housing position of the split cover member 1243 of the waste ink tank 1240 and in the position that engages the engaging portion 1243*d* provided in the first cover member 1243*a*.

Accordingly, while the waste ink tank 1240 is attached to the recording apparatus 10 and is used, the engaging portion 1243*d* and the first engagement groove 1246 are engaged with each other, and the split cover member 1243 are split into the cover members 1243*a*, 1243*b*, and 1243*c*, and are housed.

Then, the waste ink 1100 from the tube 25 will be dripped so that the ink may be absorbed by the absorbing material 1150 through the opening 1241*a*.

Then, if the replacement time of the waste ink tank 1240 comes like a case where the absorbing material 1150 of the waste ink tank 1240 is saturated with the waste ink 1100, the waste ink tank 1240 is moved in the detachment direction.

That is, in FIGS. 15 and 16, the waste ink tank 1240 is moved in the direction W1. In other words, the waste ink tank is moved in a direction in which the ink removing member 1144 exposed through the opening 1241*a* approaches the tube 25. Then, the waste ink 1100 in the vicinity of the outlet 25*a* of the tube 25 is removed by the ink removing member 1144 and is dripped so that the waste ink may be absorbed by the absorbing material 1150. This point is as described in the third embodiment.

At this time, as shown in FIG. 17, the engaging portion 1243*d* of the split cover member 1243 is disengaged from the above-mentioned engagement groove 1246, and the engaging groove 1243*d* is placed in a guide groove 1248 provided at the end of the housing 1241 on the side of the opening 1241*a* so that the engaging portion 1243*d* may be moved along the guide groove 1248.

Then, if the waste ink tank 1240 is moved in the taking-out direction, the engaging portion 1243*d* slides on the guide groove 1248, and moves to a position where the ink removing member 1144 is covered so that the split cover member 1243 may stay in the vicinity of the entrance Q of for waste ink tank 1240 of the waste ink tank holding unit 1142. That is, the position of the split cover member 1243 to the recording apparatus 10 when the waste ink tank 1240 is attached to the recording apparatus does not change so much. While the engaging portion 1243*d* slides on the guide groove 1248, the split cover member 1243 moves to the position of the ink removing member 1144 on the waste ink tank 1240.

As shown in FIGS. 18 and 19, when the waste ink tank 1240 is detached from the recording apparatus 10, the cover members 1243*a*, 1243*b*, and 1243*c* of the split cover member 1243 are integrated so that the ink removing member 1144 may be covered in the vicinity of the entrance for the waste ink tank 1240 of the waste ink tank holding unit 1142. Then, in this state, the waste ink tank 1240 is detached and is replaced with the other.

At this time, for example, the engaging portion 1243*d* provided in the first cover member 1243*a* of the split cover member 1243 slides along the guide groove 1248 provided at the end of the waste ink tank 1240 on the side of the opening 1241*a* of the housing 1241, and moves in the direction W1 in that is the detachment direction of the waste ink tank 1240.

Then, if the position of the split cover member 1243 on the waste ink tank 1240 arrives at the position where the ink removing member 1144 is installed, a second engagement groove 1247 provided in the position of the ink removing member 1144 in the position that is closest to the tube 25 in the ink removing member 1144, and the engaging portion 1243*d* of the split cover member 1243 engage each other. Furthermore, the cover member 1243*a* and the like of the split cover member 1243 are slid gradually from this position, and are integrated. Then, one end of the third cover member 1243*c* is placed in a placement portion 1241*b* of the housing 1241.

Although the split cover member 1243 that is split into three pieces, i.e., first to third cover members 1243*a*, 1243*b*, and 1243*c* is shown, the number of split pieces is not limited thereto, and can be selected suitably. Further, the shape of the split cover member 1243, and the method of covering the ink removing member 1144 are also not limited thereto, and other methods may be adopted.

The split cover member 1243 is an example of a covering member that covers the ink removing member 1144 that is a removing member housing mechanism that houses the ink removing member 1144 that is an example of a removing member so that the ink removing member may not be exposed through the opening 1241*a* of the housing 1241 that is an example of a housing portion of the waste ink tank 1240, when the waste ink tank 1240 that is an example of a liquid storage portion is detached from the recording apparatus 10 that is an example of a liquid ejection apparatus.

Also, when the waste ink tank 1240 is attached to the recording apparatus 10, the split cover member 1243 that is an example of a covering member is split into the cover members 1243*a*, 1243*b*, and 1243*c* and is housed, in the position in a direction which the waste ink tank 1240 is attached, that is, in the vicinity of the entrance of the waste ink tank holding member 1142 when the waste ink tank 1240 is attached.

Also, when the waste ink tank 1240 is detached from the recording apparatus 10, the cover members 1243*a*, 1243*b*, and 1243*c* of the split cover member 1243 are integrated in the position of the ink removing member 1144, and are locked to the housing 1241 of the waste ink tank 1240.

Accordingly, when the waste ink tank 1240 is attached and used, the split cover member 1243 is split and housed, the housing space can be made small. Also, when the waste ink tank 1240 is detached from the recording apparatus 10, the cover members 1243*a*, 1243*b*, and 12430 of the split cover member 1243 that are examples of a covering member that are split and housed are integrated and locked to the housing 1241. Thus, when the waste ink tank 1240 that is an example of a liquid storage portion is detached, the ink removing member 1144 that is an example of a removing member can be covered sufficiently. For this reason, a user and the like are not soiled when the waste ink tank that is an example of a liquid storage portion is detached or replaced.

Fifth Embodiment

Next, a fifth embodiment of the invention will be described with reference to FIGS. 20 to 22.

In the fifth embodiment, constructional elements that are common to those of the third embodiment are denoted by the same reference numerals, and the description thereof is omitted, and the following description will be made mainly about different portions.

Figure 20:
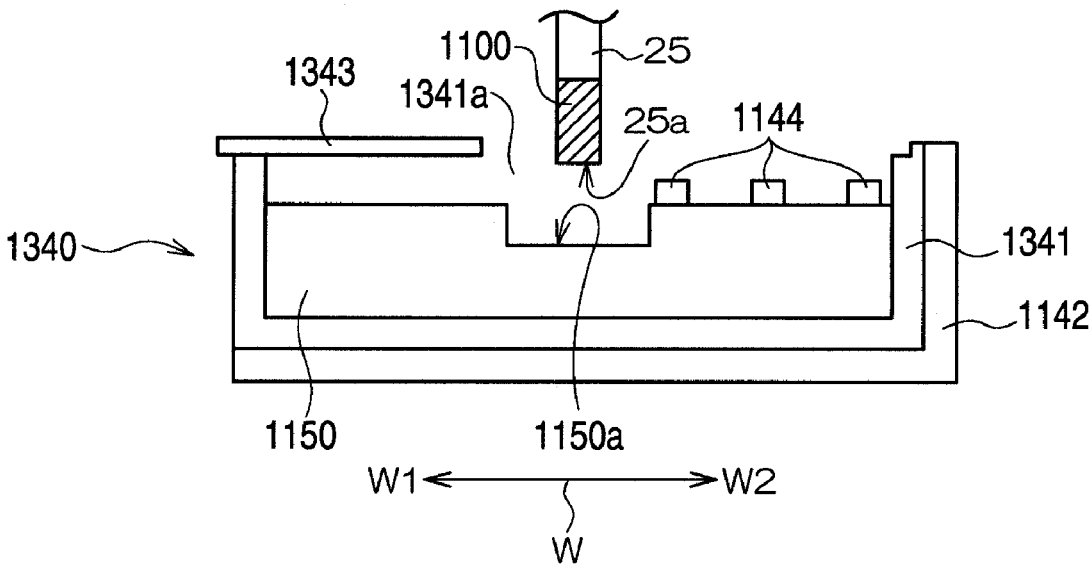
FIG. 20 is a schematic view showing the end face, etc. of the waste ink tank.
Figure 21:
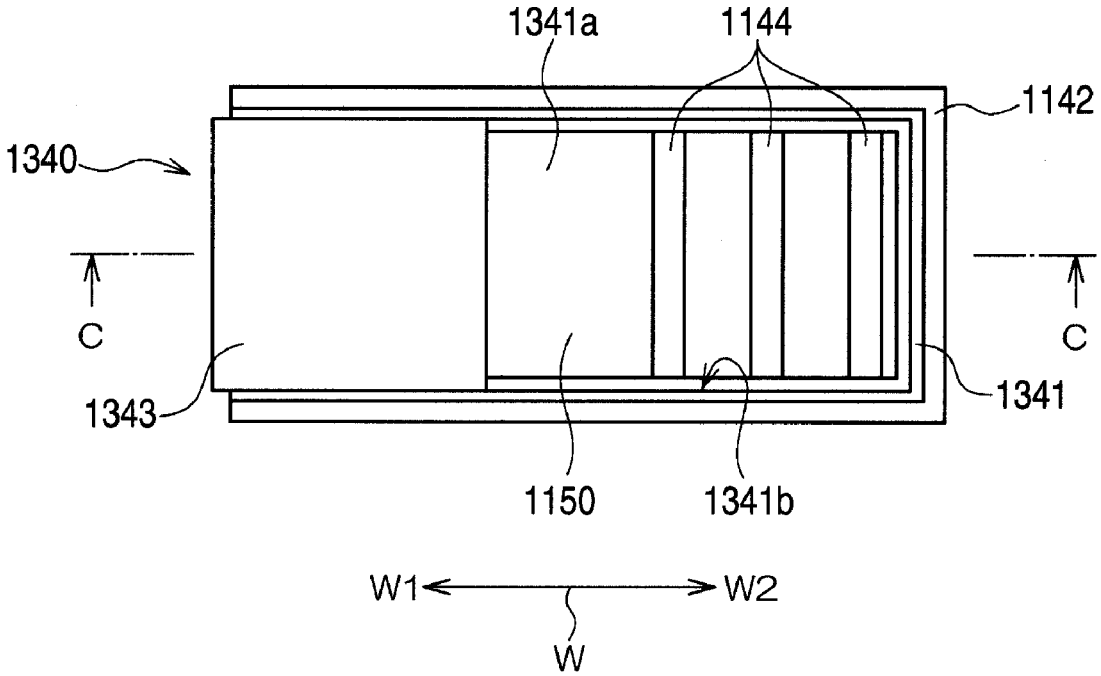
FIG. 21 is a schematic view showing the upper face of the waste ink tank.

FIG. 20 is a schematic end view of a waste ink tank 1340, and shows a schematic end view taken along the line C-C in a schematic top view of the waste ink tank 1340 shown in FIG. 21. The positional relationship among the waste ink tank 1340, tube 25, and slide cover member 1343 in the recording apparatus 10 is shown.

FIG. 21 is a schematic top view of the waste ink tank 1340, and shows a schematic top view as seen from the direction of the tube 25 in FIG. 20.

Figure 22:
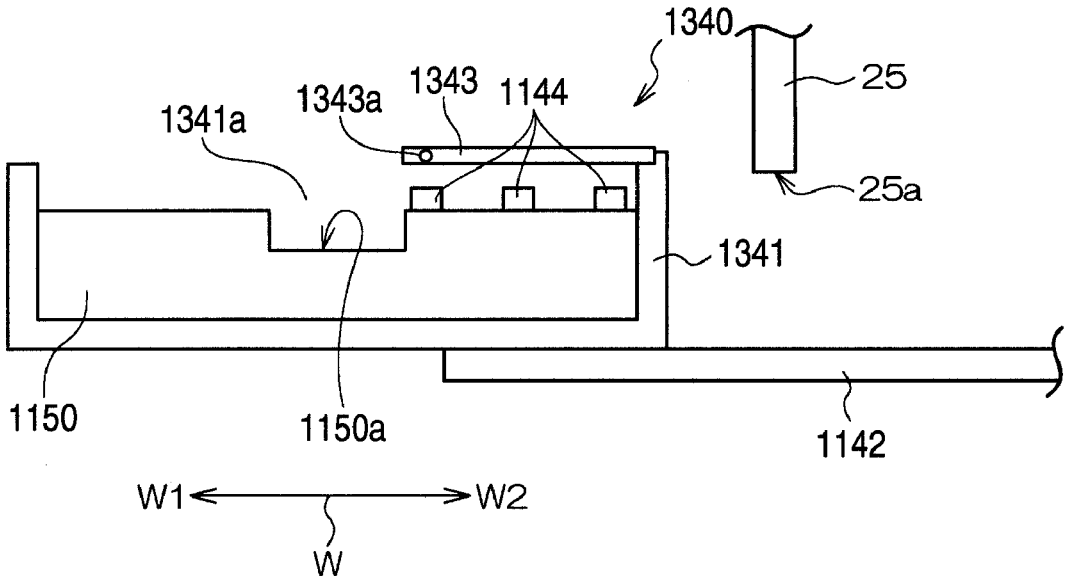
FIG. 22 is a schematic view showing the end face, etc. of the waste ink tank.

Also, FIG. 22 is a schematic end view of the waste ink tank 1340 in a position corresponding to the position taken along the line C-C similarly to FIG. 20, and shows positional relationship among the tube 25, the waste ink tank 1340, the slide cover member 1343, and the like.

Here, similarly to the third embodiment, the waste ink tank 1340 has the ink removing member 1144, the inside of the waste ink tank 1340 is provided with the absorbing material 1150, and the substantially central portion of the absorbing material 1150 is provided with the concave portion 1150*a*. The function of each of them is the same as that described in the third embodiment.

In addition, the waste ink tank 1340 is an example of a liquid storage portion, and the housing 1341 is an example of a housing portion. The slide cover member 1343 is an example of a covering member serving as a removing member housing mechanism.

In the fifth embodiment, the slide cover member 1343 is shown as an example of a covering member serving as a removing member housing mechanism that houses the ink removing member 1144.

When the waste ink tank 1340 is attached to the recording apparatus 10 and is used, the slide cover member 1343 is arranged at one end of a waste ink tank, i.e., in a region where the ink removing member 1144 is not arranged.

Also, when the waste ink tank 1340 is moved in the detachment direction (in the direction W1 on the drawing), the slide cover member 1343 is moved along a slide groove 1341*b* provided in the housing 1341 of the waste ink tank 1340. That is, with movement of the waste ink tank 1340, the slide cover member moves on the opening 1341*a* of the waste ink tank 1340, and moves so as to cover the region where the ink removing member 1144 is provided. At this time, the waste ink tank 1340 moves, and the arrangement relationship between the tube 25 and the slide cover member 1343, i.e., the position of the slide cover member 1343 in the direction W that is the movement direction of the waste ink tank 1340 hardly changes.

When the waste ink tank 1340 is used, the slide cover member 1343 is locked to the housing 1341 of the waste ink tank 1340 so as not to deviate.

Then, as shown in FIG. 22, the waste ink tank 1340 is gradually taken out of the recording apparatus 10. At this time, the slide cover member 1343 is arranged so as to cover the ink removing member 1144 in the position of the waste ink tank 1340 where the ink removing member 1144 is installed. The positional relationship of the slide cover member 1343 with the recording apparatus 10 does not change so much until it is detached from the recording apparatus 10 along with the waste ink tank 1340. However, the positional relationship between the slide cover member 1343 and the waste ink tank 1340 changes with movement of the waste ink tank 1340 such that the slide cover member is made to gradually approach the position where the ink removing member 1144 is arranged.

This movement, i.e., the movement in the direction W1 on the drawing, in other words, the movement in the direction in which the ink removing member 1144 gradually approaches the tube 25.

When the waste ink tank 1340 is detached, the ink removing member 1144 is covered with the slide cover member 1343.

Accordingly, when the waste ink tank 1340 is attached and used, the slide cover member 1343 is arranged in the vicinity of one end of the waste ink tank 1340 where the ink removing member 1144 is not arranged. Thus, the waste ink 1100 from the tube 25 is sufficiently absorbed by the absorbing material.

Further, since the whole opening 1341*a* of the housing 1341 of the waste ink tank 1340 is not covered, the waste ink 1100 absorbed by the absorbing material 1150 can also be evaporated.

Also, when the waste ink tank 1340 is detached from the recording apparatus 10, the slide cover member 1343 that is an example of a covering member is moved to the position of the ink removing member 1144, so that the slide cover member 1343 can sufficiently cover the ink removing member 1144. Accordingly, a user and the like are not soiled when the waste ink tank that is an example of a liquid storage portion is detached or replaced.

Sixth Embodiment

Next, a sixth embodiment of the invention will be described with reference to FIGS. 23 to 27.

In the sixth embodiment, constructional elements that are common to those of the third embodiment are denoted by the same reference numerals, and the description thereof is omitted, and the following description will be made mainly about different portions.

Figure 23:
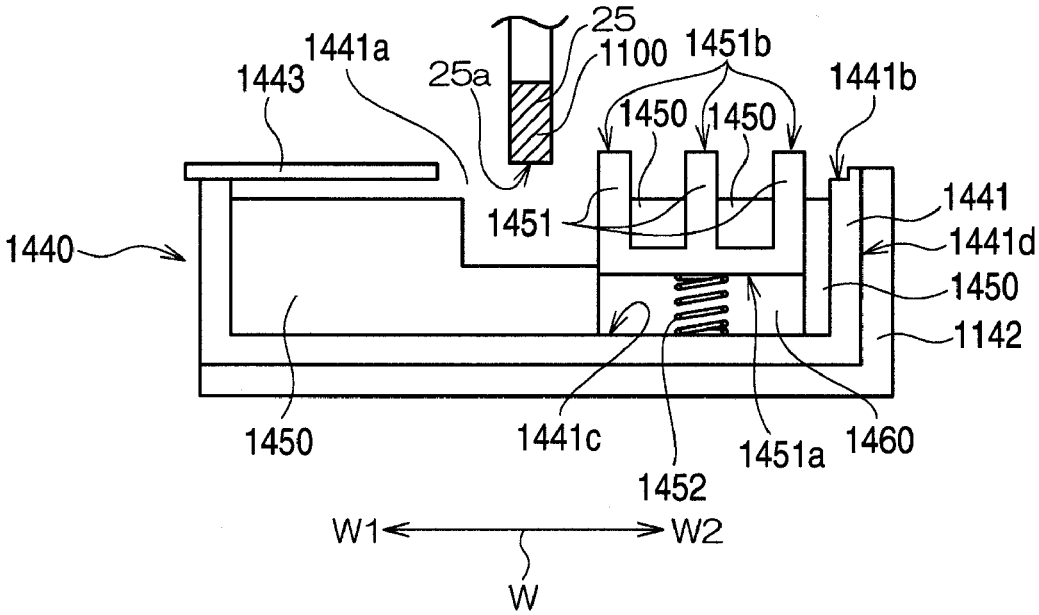
FIG. 23 is a schematic view showing the end face, etc. of the waste ink tank.
Figure 24:
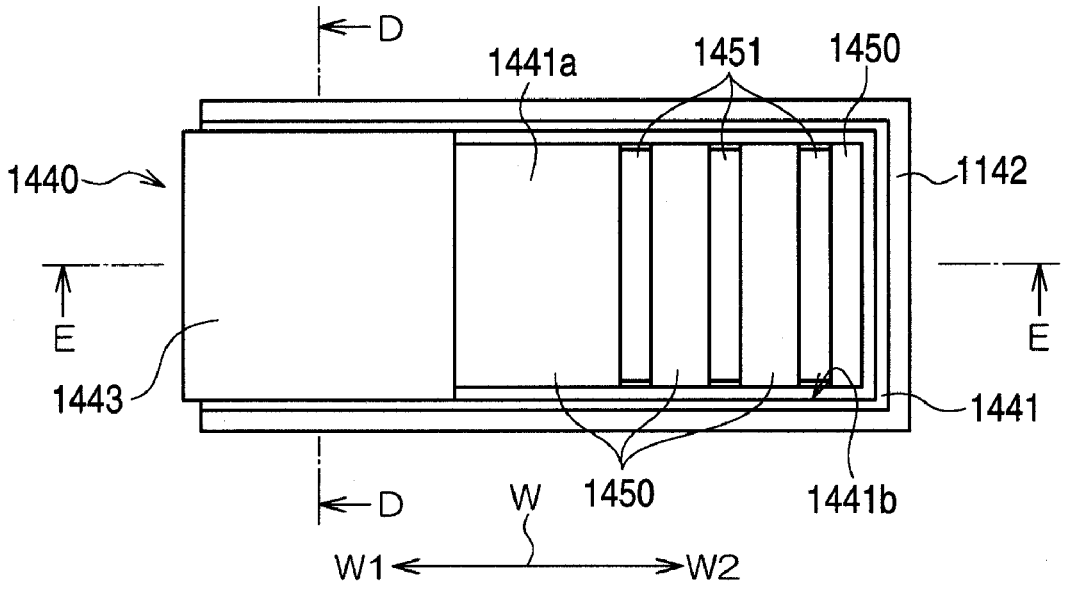
FIG. 24 is a schematic view showing the upper face of the waste ink tank.

FIG. 23 is a schematic end view of a waste ink tank 1440, and shows a schematic end view taken along the line E-E in a schematic top view of the waste ink tank 1440 shown in FIG. 24. The positional relationship among the waste ink tank 1440, the tube 25, an ink removing member 1451, a slide cover member 1443, and the like, in a state where the waste ink tank 1440 is attached to the recording apparatus 10 is shown.

Figure 25:
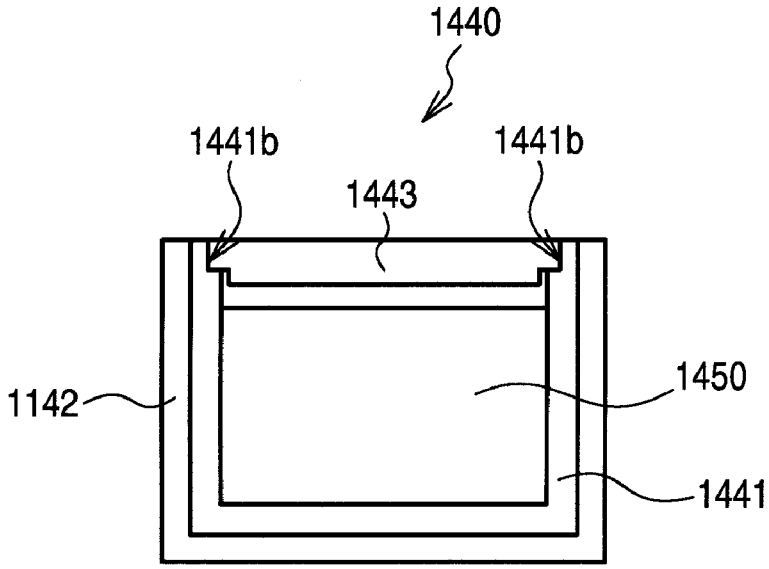
FIG. 25 is a schematic view showing the end face, etc. of the waste ink tank.
Figure 26:
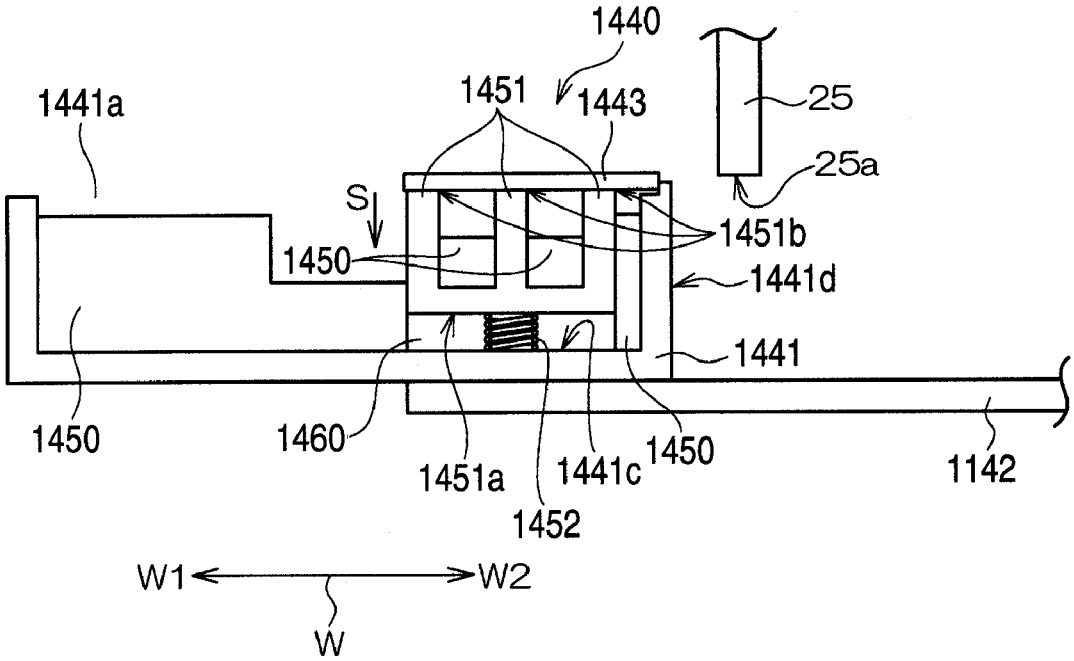
FIG. 26 is a schematic view showing the end face, etc. of the waste ink tank.

FIG. 24 is a schematic top view of the waste ink tank 1440, and shows a schematic top view as seen from the direction of the tube 25 in FIG. 23. FIG. 25 is a schematic end view taken along the line D-D of FIG. 24, and shows the housing 1441 of the waste ink tank 1440, the slide cover member 1443, an absorbing material 1450, and the like. Further, FIG. 26 is a schematic end view of the waste ink tank 1440 similarly to FIG. 23, and shows the positional relationship among the tube 25, the waste ink tank 1440, the ink removing member 1451, the slide cover member 1443, and the like, when the waste ink tank 1440 is attached to the recording apparatus 10. FIG. 26 is a sectional side view in the line E-E in the schematic top view of FIG. 27.

Figure 27:
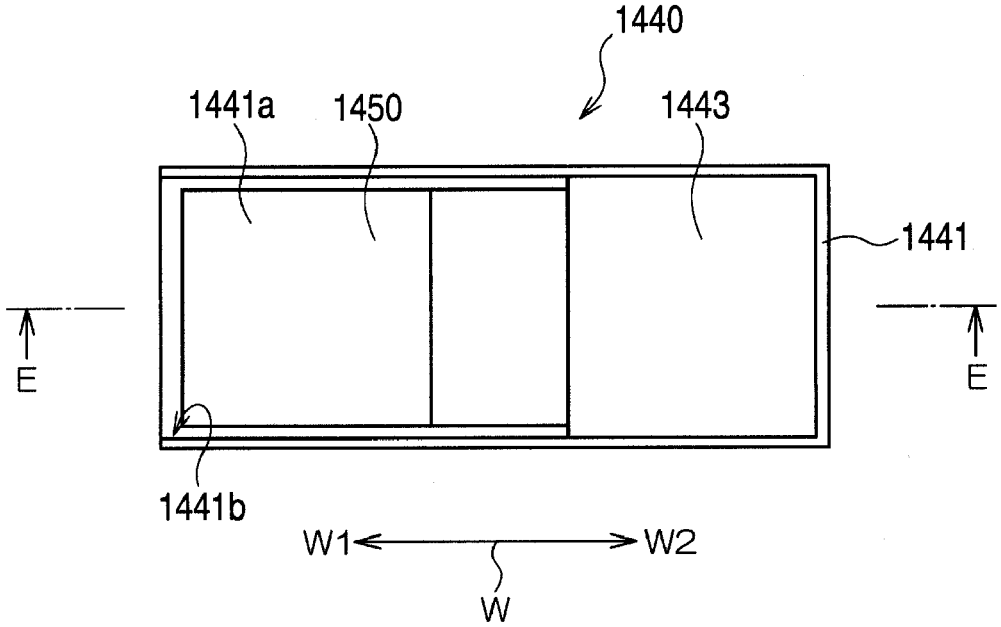
FIG. 27 is a schematic view showing the upper face of the waste ink tank.

Also, FIG. 27 is a schematic top view of the waste ink tank 1440 in FIG. 26, and shows a schematic top view as seen from the direction of the tube 25 in FIG. 26.

In addition, the waste ink tank 1440 is an example of a liquid storage portion, and the ink removing member 1451 is an example of a removing member.

As shown in FIG. 23, the waste ink tank 1440 has the housing 1441 having an opening 1441*a* in its surface that faces the outlet 25*a* of the tube 25, and an absorbing material 1450 inside the housing 1441.

The function of the absorbing material 1450 is the same as that of the absorbing material 1150 of the third embodiment, and the waste ink 1100 discharged from the tube 25 is absorbed by the absorbing material 1450.

The fifth embodiment is different from the third embodiment in that the absorbing material 1450 is split into several pieces and housed within the housing 1441 of the waste ink tank 1440, an ink removing member housing portion 1460 that is an example of a housing portion that houses the ink removing member 1451 to be described later is provided, and the slide cover member 1443 as a covering member that covers the ink removing member 1451 is provided.

The ink removing member 1451 is arranged so as to be exposed through the opening 1441*a*, for example, in three places in the region of the opening 1441*a* of the waste ink tank 1440.

In addition, the absorbing material 1450 is an example of an absorbing member, the housing 1441 is an example of a housing portion, and the slide cover member 1443 is an example of a covering member of a removing member housing mechanism.

Furthermore, as shown in FIG. 23, the ink removing member 1451 is integrated, for example, inside the housing 1441 of the waste ink tank 1440 that is below the ink removing member. The space between a lower end surface 1451*a* that is integrated below the ink removing member, and an internal bottom surface 1441*c* of the housing 1441 of the waste ink tank 1440 serves as the ink removing member housing portion 1460 for housing the ink removing member 1451.

Between the lower end surface 1451*a* of the ink removing member 1451 and the internal bottom surface 1441*c* of the housing 1441 of the waste ink tank 1440, for example, a coil spring 1452 that is a biasing portion that biases the ink removing member 1451 is provided.

Here, the ink removing member housing portion 1460 is an example of a housing portion, and the coil spring 1452 is an example of a biasing portion.

As shown in FIG. 23, when the waste ink tank 1440 is attached to the recording apparatus 10, the ink removing member 1451 is arranged so as to be exposed through the opening 1441*a* of the housing 1441 of the waste ink tank 1440 by the coil spring 1452.

Further, the absorbing material 1450 within the waste ink tank 1440 are split within the housing 1441 of the waste ink tank 1440, and for example, the space except the place where the ink removing member 1451, the ink removing member housing portion 1460, and the like are provided is buried by an absorbing material.

For example, when a plurality of the ink removing members 1451 are, the absorbing material is also arranged between such ink removing members 1451.

If this arrangement is adopted, the absorbing material 1450 can be sufficiently arranged within the housing 1441 of the waste ink tank 1440.

When the waste ink tank 1440 is taken out of the recording apparatus 10, the ink removing member 1451 is provided in a direction in which it gradually approaches the tube 25 in the waste ink tank 1440. That is, the ink removing member is provided in the direction W2 on the drawing.

In FIG. 23, in a state where the waste ink tank 1440 is attached to the recording apparatus 10 and is used, the ink removing member 1451 is arranged so as to be exposed through the opening 1441*a* of the housing 1441 of the waste ink tank 1440. The slide cover member 1443 is arranged in the region opposite the ink removing member 1451 across the tube 25, i.e., in the region where the ink removing member 1451 is not arranged. On the drawing of FIG. 23, the slide cover member 1443 is arranged in the direction W1. For this reason, when the waste ink 1100 discharged from the tube 25 is absorbed by the absorbing material 1450, the waste ink 1100 is carried along the ink removing member 1451 exposed through the opening 1441*a*, is guided to the absorbing material 1450, and is caught by the absorbing material 1450.

As shown in FIGS. 23 to 25, the end of the waste ink tank 1440 on the side of the opening 1441*a* of the housing 1441 is provided with a slide guide groove 1441*b*.

Then, the slide cover member 1443 can be slid by the slide guide groove 1441*b*. This construction is the same as that of the slide cover member 1343 described in the fifth embodiment.

That is, when the waste ink tank 1440 is moved in the detachment direction (in the direction W1 on the drawing), the slide cover member 1443 is moved through the opening 1441*a* of the waste ink tank 1440 so as to move along a slide guide groove 1441*b* provided in the housing 1441 of the waste ink tank 1440. That is, with movement of the waste ink tank 1440, the slide cover member moves on the opening 1441*a* of the waste ink tank 1440, and moves so as to cover the region where the ink removing member 1451 is provided.

Next, the state where, when the waste ink tank 1440 is detached from the recording apparatus 10, the ink removing member 1451 is housed in an ink removing member housing portion 1460, and is covered and housed by the slide cover member 1443 will be described with reference to FIGS. 26 and 27.

Referring to FIGS. 26 and 27, when the waste ink tank 1440 is moved in the detachment direction from the recording apparatus 10, the ink removing member 1451 removes the waste ink 1100 in the vicinity of the outlet 25 of the tube 25, and causes the waste ink to be absorbed by the absorbing material 1450.

In this state, the ink removing member 1451 is in a state of being exposed through the opening 1441*a* the housing 1441 of the waste ink tank 1440.

That is, the ink removing member 1451 is in a state of being exposed through the opening 1441*a* of the housing 1441 of the waste ink tank 1440 until the waste ink tank 1440 is moved in a direction in which the ink removing member 1451 approaches the tube 25, and then, the ink removing member 1451 moves in a direction away from the tube 25.

Then, the slide cover member 1443 is moved to the position of the ink removing member 1451 along the slide guide groove 1441*b* provided on the side of the opening 1441*a* of the housing 1441 of the waste ink tank 1440.

Then, the slide cover member 1443 abuts on the ink removing member 1451.

Then, if the waste ink tank 1440 is further moved in the detachment direction, the slide cover member 1443 moves so as to cover the ink removing member 1451, and moves to a wail 1441*d* on the side where the ink removing member 1451 of the housing 1441 of the waste ink tank 1440 is provided.

Further, a coil spring 1452 is installed between the internal bottom surface 1441*c* of the housing 1441 of the waste ink tank 1440 and the lower end surface 1451*a* of the ink removing member 1451, and the ink removing member 1451 is held so as to be exposed through the opening 1441*a* by the biasing force of the coil spring 1452. Thus, when the ink removing member 1451 is covered with the slide cover member 1443, an upper end surface 1451*b* of the ink removing member 1451 is pushed by the slide cover member 1443, and thereby the ink removing member 1451 is housed in the ink removing member housing portion 1460 inside the housing 1441 of the waste ink tank 1440. In this case, the direction in which the coil spring 1452 is compressed is the direction of the arrow S on the drawing of FIG. 26, and the direction in which the ink removing member 1451 is housed in the housing 1441 of the waste ink tank 1440.

Accordingly, when the waste ink tank 1440 is attached to the recording apparatus 10 and is used, the slide cover member 1443 is arranged in the vicinity of one end of the waste ink tank 1440 where the ink removing member 1451 is not arranged. The ink removing member 1451 is provided so as to be exposed through the opening 1441*a* by the coil spring 1452 that is an example of a biasing portion provided in the ink removing member housing portion 1460 that is an example of a housing portion between the lower end surface 1451*a* of the ink removing member 1451 and the internal bottom surface 1441*c* of the housing 1441 of the waste ink tank 1440. Also, the slide cover member 1443 that is an example of a covering member is installed in the waste ink tank 1440 in the position where the ink removing member 1451 is not provided.

Therefore, since the waste ink 1100 from the tube 25 can be sufficiently absorbed by the absorbing material 1450, and there is no case where the whole opening 1441*a* of the housing 1441 of the waste ink tank 1440 is covered, the waste ink 1100 absorbed by the absorbing material 1450 can also be evaporated.

Also, when the slide cover member 1443 is detached from the recording apparatus 10 in order to replace the waste ink tank 1440 with the other, the waste ink tank 1440 is moved so that the slide cover member 1443 may move to the position of the ink removing member 1451. Also, the ink removing member 1451 is housed in the ink removing member housing portion 1460 by the slide cover member 1443.

Then, when the waste ink tank 1440 is detached, the slide cover member 1443 will cover the ink removing member, and the ink removing member 1451 is housed in the ink removing member housing portion 1460 that is the inside of the waste ink tank 1440. These are examples of a housing mechanism for the ink removing member 1451.

Accordingly, a user and the like are not soiled when the waste ink tank that is an example of a liquid storage portion is detached or replaced.

Here, the slide cover member 1443, the ink removing member housing portion 1460, and the coil spring 1452 become examples of a removing member housing mechanism that houses the ink removing member 1451 so as not to be exposed through the opening 1441*a*.

When the waste ink tank 1440 is used (refer to FIG. 23) the slide cover member 1443 is locked to the housing 1441 of the waste ink tank 1440 so as not to deviate.

In the sixth embodiment, the slide cover member 1443 that is an example of a covering member and the ink removing member housing portion 1460 that is an example of a housing portion that are used together. However, only the covering member or only the housing portion may be used. Further, although the coil spring 1452 is used as a biasing portion, a leaf spring, etc. may be used.

Seventh Embodiment

Next, a seventh embodiment of the invention will be described with reference to FIGS. 28 to 30.

In the seventh embodiment, constructional elements that are common to those of the third embodiment are denoted by the same reference numerals, and the description thereof is omitted, and the following description will be made mainly about different portions.

FIG. 23 is a schematic end view for explaining states, such as a state where a waste ink tank 1540 according to the seventh embodiment is attached to the recording apparatus 10.

Figure 29:
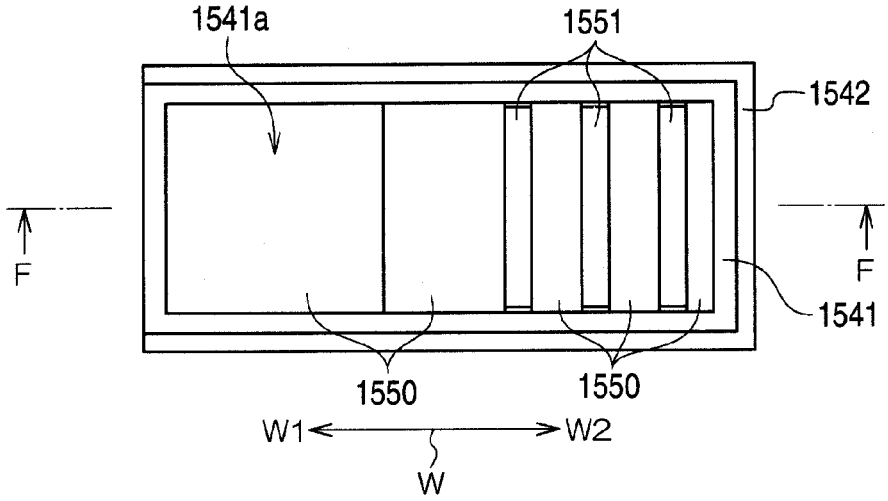
FIG. 29 is a schematic view showing the upper face of the waste ink tank.

FIG. 29 is a schematic top view of the waste ink tank 1540.

Figure 28:
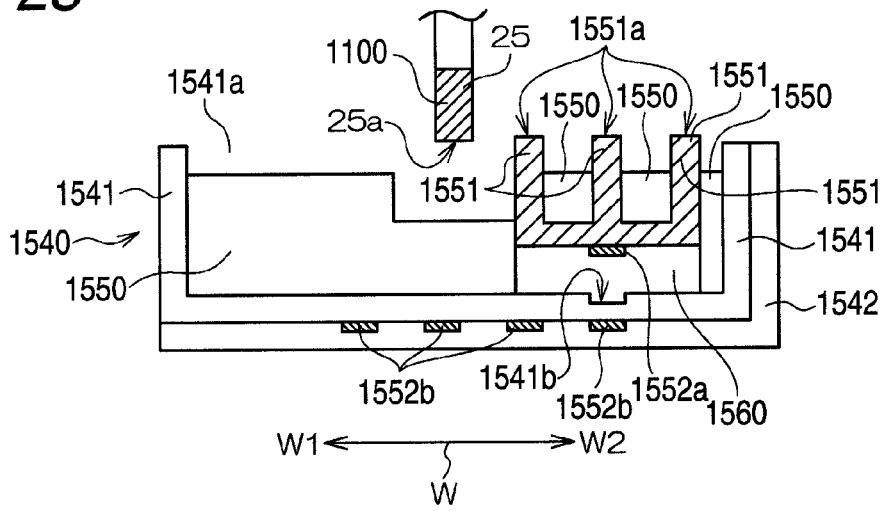
FIG. 28 is a schematic view showing the end face, etc. of the waste ink tank.

Here, FIG. 28 is a schematic end view shown along the line F-F of FIG. 29, and shows the relationship with the tube 25 that is not shown in FIG. 29.

That is, FIG. 29 shows the waste ink tank 1540 from the direction of the tube 25.

Figure 30:
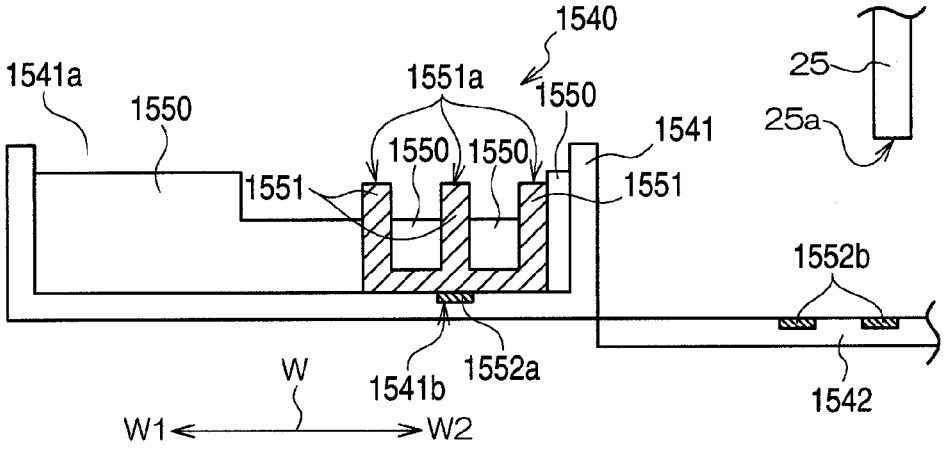
FIG. 30 is a schematic view showing the end face, etc. of the waste ink tank.

Also, FIG. 30 shows a schematic end view of the waste ink tank 1540 similarly to FIG. 28. FIG. 28 shows the state where the waste ink tank is attached to the recording apparatus 10, whereas FIG. 30 is a schematic end view showing the state of the waste ink tank 1540, etc. when the waste ink tank 1540 is located in the vicinity of the entrance of the waste ink tank holding unit 1542 when the waste ink tank 1540 is detached from the recording apparatus 10.

The waste ink tank 1540 has a housing 1541 having an opening 1541*a* in its surface that faces the outlet 25*a* of the tube 25, and an absorbing material 1550 inside the housing 1541.

The function of the absorbing material 1550 is the same as that of the absorbing material 1150 of the third embodiment, and the waste ink 1100 discharged from the tube 25 is absorbed by the absorbing material 1550.

The seventh embodiment is different from the third embodiment in that the absorbing material 1550 is split into several pieces and housed within the housing 1541 of the waste ink tank 1540, and an ink removing member housing portion 1560 that is an example of a housing portion that houses an ink removing member 1551 to be described later is provided.

The ink removing member housing portion 1560 become an example of a removing member housing mechanism that houses the ink removing member 1551 so as not to be exposed through an opening 1551*a*. The arrangement and the like of the absorbing material 1550 are the same as those of, for example, the absorbing material 1450 of the sixth embodiment.

In addition, the waste ink tank 1540 is an example of a liquid storage portion, the housing 1541 are an example an example of a housing portion, and the ink removing member 1551 is an example of a removing member.

As shown in FIGS. 28 and 29, when the waste ink tank 1540 is attached to the recording apparatus 10 and is used, the ink removing member 1551 is exposed through the opening 1551*a*.

That is, in the housing 1541 of the waste ink tank 1540, the ink removing member 1551 is exposed through the opening 1551*a* in its surface that faces the outlet 25*a* of the tube 25 so as to approach the outlet 25*a* of the tube 25. Furthermore, the positional relationship between the outlet 25*a* of the tube and the upper end surface 1551*a* of the ink removing member 1551, and the relationship in the height direction in which the ink removing member 1551 and the outlet 25*a* of the tube 25 are installed are similar to each other.

In this way, if the position where the tube 25 that faces the opening 1541*a* of the waste ink tank 1540 is installed in a state where the waste ink tank 1540 is attached to the recording apparatus 10 and is used is adopted as a substantially central portion of the waste ink tank 1540, the ink removing member 1551 is provided in one region of the waste ink tank 1540 across the central portion.

That is, when the waste ink tank 1540 is taken out of the recording apparatus 10, the ink removing member is provided in a direction in which it gradually approaches the tube 25.

In the drawing, the ink removing member is provided on the side of the direction W2, and when the waste ink tank 1540 has been moved in the direction W1, the ink removing member is provided in a direction in which it gradually approaches the tube 25.

Also, the ink removing member 1551 is provided so as to be exposed through the opening 1541*a*, for example, in three places. The ink removing member 1551 is integrated, for example, inside the housing 1541 of the waste ink tank 1540 that is below the ink removing member.

Further, the space is provided between the lower portion of the ink removing member 1551, and the housing 7 of the waste ink tank 1540, and this space serves as the ink removing member housing portion 1560 for housing the ink removing member 1551.

Also, a first magnetism generating portion 1552*a* that is an example of a biasing portion is provided under the ink removing member 1551, i.e., on the lower end surface thereof.

Further, for example, a first magnetism generating portion accommodating recess 1541*b* may be provided in the housing 1541, specifically, in the internal bottom surface of the housing 1541 in the position corresponding to the first magnetism generating portion 1552*a*. Also, the first magnetism generating portion accommodating recess 1541*b* should be sized such that it can accommodate the first magnetism generating portion 1552*a*.

Also, the first magnetism generating portion accommodating recess 1541*b* accommodates the first magnetism generating portion 1552*a* arranged under the ink removing member 1551, when the ink removing member 1551 is housed in the ink removing member housing portion 1560.

A second magnetism generating portion 1552*b* that is an example of a biasing portion similarly is provided in the waste ink tank holding unit 1542. The first and second magnetism generating portions 1552*a* and 1552*b* are, for example, magnets, etc., and they are arranged so that repulsive magnetism may be generated between the first magnetism generating portions 1552*a* and the second magnetism generating portion 1552.*b* provided in the position corresponding to the first magnetism generating portion. For example, the magnets have an S pole and an S pole, an N pole and an N pole, etc.

The ink removing member 1551 is arranged so as to be exposed through the opening 1541*a* by this repulsive force.

Accordingly, when the waste ink tank 1540 is attached to the recording apparatus 10 and is used, the ink removing member 1551 is arranged so as to be exposed through the opening 1541*a* by the first and second magnetism generating portions 1552*a* and 1552*b*. The ink removing member 1551 will be in the state of being exposed through the opening 1541*a* until the ink removing member 1551 approaches the tube 25, and then removes the waste ink 1100 remaining in the vicinity of the opening side 25*a* of the tube 25.

That is, in order to remove the ink removing member 1551 so as to be exposed through the opening 1541*a*, a plurality of the second magnetism generating portions 1552*b* arranged on the side of the ink tank holding member 1542 so as to correspond to the first magnetism generating portion 1552*a* are provided. While the waste ink tank 1540 is moving above the place where the second magnetism generating portions 1552*b* are provided, for example, the repulsive magnetism is generated between the second magnetism generating portions 1552*a* and 1552*b*, and the ink removing member 1551 is exposed through the opening 1541*a*.

The ink removing member 1551 is an example of a removing member that removes the waste ink 1100 in the vicinity of the outlet 25*a* of the tube 25 to cause the waste ink 1100 to be absorbed by the absorbing material 1550, thereby preventing scattering of the waste ink 1100.

Also, as shown in FIG. 30, if the waste ink tank 1540 is detached from the recording apparatus 10, the ink removing member 1551 is housed in the ink removing member housing portion 1560.

That is, by biasing the ink removing member 1551 by the repulsive force generated by the magnetism between the first magnetism generating portion 1552*a* and the second magnetism generating portion 1552*b*, the ink removing member 1551 is arranged so as to be exposed through the opening 1541*a*. However, if the waste ink tank 1540 is detached, any repulsive force does not work between the first and second magnetism generating portions 1552*a* and 1552*b*, and therefore the repulsive force also does not work. Accordingly, the ink removing member 1551 is housed in the ink removing member housing portion 1560, and is not exposed through the opening 1541.

At this time, if the first magnetism generating portion accommodating recess 1541*b* is provided as an accommodating portion of the first magnetism generating portion 1552*a*, the ink removing member 1551 can be housed so as not to be exposed through the opening 1541*a* that much.

The ink removing member housing portion 1560 is an example of a housing portion, and the first and second magnetism generating portions 1552*a* and 1552*b* are examples of a biasing portion.

According to the waste ink tank 1540, when the waste ink tank 1540 is detached from the recording apparatus 10, the ink removing member 1551 is housed in the ink removing member housing portion 1560, and is housed in the waste ink tank 1540, by the biasing portion of the first and second magnetism generating portions 1552*a* and 1552*b*.

Accordingly, since the ink removing member 1551 is not exposed through the opening 1541*a*, a user and the like are not soiled when the liquid storage portion is replaced.

The invention is not limited to the above embodiments as a recording apparatus, but various changes may be made without departing from the scope of the claims. Moreover, the above-mentioned embodiments are combined together. Further, the invention is not limited to the recording apparatus, and may be applied to liquid ejection apparatuses using liquid ejection heads that eject liquid, such as a recording head used for an image recording apparatus, such as a printer, a color material ejection head used to manufacture color filters of a liquid crystal display, etc., an electrode material ejection head used to form electrodes of an organic EL display, a surface emission display (FED), etc., and a living body organic matter ejection head used to manufacture biochips, a sample ejection apparatus as a precision pipette, and the like.

Further, some of the individual constructional elements of the above-mentioned embodiments can be omitted, or the elements can be arbitrarily combined differently from the above.

This application claims priority from Japanese Patent Application Nos. 2006-302479 filed on Nov. 8, 2006 and 2006-319736 filed on Nov. 28, 2006, the entire disclosure of which are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the sprit and scope of the invention.

What is claimed is:

1. A liquid storage portion that absorbs and stores liquid discharged from a guide portion that guides the liquid discharged by a liquid ejection head to an absorbing member, using the absorbing member, the liquid storage portion comprising:

a housing portion having an opening in its surface facing an outlet of the guide portion on a side of the absorbing member;

the absorbing member arranged within the housing;

a removing member for removing the liquid remaining in a vicinity of the outlet of the guide portion on the side of the absorbing member; and a removing member housing mechanism that houses the removing member so as not to be exposed through the opening when the liquid storage portion is detached and contacts the outlet of the guide portion when the liquid storage portion is detached from the guide portion.

2. The liquid storage portion according to claim 1, wherein the removing member housing mechanism has a covering member that covers the removing member.

3. The liquid storage portion according to claim 1, wherein the removing member housing mechanism has a housing portion for housing the removing member within the housing.

4. The liquid storage portion according to claim 2, wherein, when the liquid storage portion is attached, the covering member is folded and housed in a vicinity of a wall of the housing portion that is apart from the removing member, and when the liquid storage portion is detached, the covering member is unfolded in a vicinity of a wall of the housing portion that is near to the removing member.

5. The liquid storage portion according to claim 2, wherein, when the liquid storage portion is attached, the covering member is split and housed in a vicinity of a wall of the housing portion that is apart from the removing member, and when the liquid storage portion is detached, the covering member is integrated and locked to the housing in a vicinity of a wall of the housing portion that is near to the removing member.

6. The liquid storage portion according to claim 3, wherein the housing portion has a biasing portion that biases the removing member, and when the liquid storage portion is detached, the removing member is housed within the housing by the biasing portion.

7. A liquid ejection apparatus comprising:

a guide portion that guides to an absorbing member liquid discharged from a liquid ejection head for ejecting the liquid; and a liquid storage portion that absorbs and stores the liquid discharged from the guide portion using the absorbing member, the liquid storage portion comprising:

a housing portion having an opening in its surface facing an outlet of the guide portion on a side of the absorbing member;

the absorbing member arranged within the housing;

a removing member for removing the liquid remaining in a vicinity of the outlet of the guide portion on the side of the absorbing member; and a removing member housing mechanism that houses the removing member so as not to be exposed through the opening when the liquid storage portion is detached and contacts the outlet of the guide portion when the liquid storage portion is detached from the guide portion.

8. A liquid storage portion that absorbs and stores liquid discharged from a guide portion that guides the liquid discharged by a liquid ejection head of a liquid ejection apparatus to an absorbing member, using the absorbing member, the liquid storage portion being detachable from the liquid ejection apparatus, the liquid storage portion comprising:

a housing portion having an opening;

the absorbing member arranged within the housing portion;

a removing member for removing the liquid remaining in a vicinity of the outlet of the guide portion; and a covering member that covers the removing member in a state where the liquid storage portion is detached from the liquid ejection apparatus and contacts the outlet of the guide portion when the liquid storage portion is detached from the guide portion.

* * * * *